US009670440B2

(12) United States Patent
Bullock et al.

(10) Patent No.: US 9,670,440 B2
(45) Date of Patent: Jun. 6, 2017

(54) WATER-SOLUBLE DELAYED RELEASE CAPSULES, RELATED METHODS, AND RELATED ARTICLES

(71) Applicant: MONOSOL, LLC, Merrillville, IN (US)

(72) Inventors: Stephen Bullock, Chicago, IL (US); Percy Bromby, II, Chicago, IL (US); Jennifer L. Childers, Lowell, IN (US); Jonathon Knight, Laporte, IN (US); David M. Lee, Crown Point, IN (US); Sumeet Kumar, Crown Point, IN (US); Nicholas Zeese, Michigan City, IN (US)

(73) Assignee: MONOSOL, LLC, Merrillville, IN (US)

( * ) Notice: Subject to any disclaimer, the term of this patent is extended or adjusted under 35 U.S.C. 154(b) by 0 days.

(21) Appl. No.: 14/506,269

(22) Filed: Oct. 3, 2014

(65) Prior Publication Data

US 2015/0096130 A1 Apr. 9, 2015

Related U.S. Application Data

(60) Provisional application No. 61/887,527, filed on Oct. 7, 2013.

(51) Int. Cl.

| | |
|---|---|
| ***C11D 3/10*** | (2006.01) |
| ***C11D 3/395*** | (2006.01) |
| ***C11D 7/12*** | (2006.01) |
| ***C11D 17/00*** | (2006.01) |
| ***C11D 11/00*** | (2006.01) |
| ***C11D 3/00*** | (2006.01) |
| ***C11D 17/04*** | (2006.01) |

(52) U.S. Cl.

CPC ..... *C11D 17/0039* (2013.01); *C11D 3/0052* (2013.01); *C11D 3/3953* (2013.01); *C11D 11/0017* (2013.01); *C11D 17/042* (2013.01); *Y10T 428/2982* (2015.01)

(58) Field of Classification Search

CPC ..... C11D 3/0052; C11D 3/10; C11D 3/395; C11D 3/3953; C11D 3/505; C11D 7/12; C11D 11/0017; C11D 17/042

See application file for complete search history.

(56) References Cited

U.S. PATENT DOCUMENTS

| | | | | |
|---|---|---|---|---|
| 2,220,099 | A | 11/1940 | Guenther et al. | |
| 2,477,383 | A | 7/1949 | Lewis | |
| 3,664,961 | A | 5/1972 | Norris | |
| 3,919,678 | A | 11/1975 | Penfold | |
| 4,000,093 | A | 12/1976 | Nicol et al. | |
| 4,222,905 | A | 9/1980 | Cockrell, Jr. | |
| 4,239,659 | A | 12/1980 | Murphy | |
| 4,246,612 | A | 1/1981 | Berry et al. | |
| 4,725,378 | A | 2/1988 | Krawczak | |
| 4,810,410 | A | 3/1989 | Diakun et al. | |
| 5,114,611 | A | 5/1992 | Van Kralingen et al. | |
| 5,160,654 | A * | 11/1992 | Falou | C11D 3/3927 252/186.25 |
| 5,227,084 | A | 7/1993 | Martens et al. | |
| 5,576,281 | A | 11/1996 | Bunch et al. | |
| 5,755,992 | A | 5/1998 | Jeffrey et al. | |
| 5,965,505 | A | 10/1999 | Baillely et al. | |
| 6,599,871 | B2 | 7/2003 | Smith | |
| 6,727,215 | B2 | 4/2004 | Roberts et al. | |
| 7,642,226 | B2 * | 1/2010 | Verrall | C11D 17/043 428/35.2 |
| 2003/0060390 | A1 | 3/2003 | Demeyere et al. | |
| 2003/0126282 | A1 | 7/2003 | Sarkar et al. | |
| 2003/0139312 | A1 | 7/2003 | Caswell et al. | |
| 2004/0204337 | A1 | 10/2004 | Corona et al. | |

(Continued)

FOREIGN PATENT DOCUMENTS

| | | | |
|---|---|---|---|
| CA | 2313587 | A1 | 1/2001 |
| EP | 0 197 434 | A2 | 10/1986 |
| EP | 1288287 | A2 | 3/2003 |
| EP | 2258820 | A1 | 12/2010 |
| GB | 1 137 741 | A | 12/1968 |
| GB | 2375768 | A | 11/2002 |
| GB | 2406338 | A | 3/2005 |
| WO | WO-01/36290 | A1 | 5/2001 |
| WO | WO-2006/002755 | A1 | 1/2006 |
| WO | WO-2008/087426 | A1 | 7/2008 |
| WO | WO-2012/104609 | A1 | 8/2012 |
| WO | WO-2013/069037 | A1 | 5/2013 |

OTHER PUBLICATIONS

International Search Report and Written Opinion, International Application No. PCT/US2014/059073, mailed Mar. 3, 2015.

International Preliminary Report on Patentability and Written Opinion, International Application No. PCT/US2014/059243, mailed Apr. 12, 2016.

International Preliminary Report on Patentability and Written Opinion, International Application No. PCT/US2014/059073, dated Apr. 12, 2016.

*Primary Examiner* — Charles Boyer

(74) *Attorney, Agent, or Firm* — Marshall, Gerstein & Borun LLP

(57) ABSTRACT

Disclosed herein are capsules for delayed release of an active ingredient contained therein, in particular water-soluble capsules for delayed release of water-sensitive, gas-generating compositions into an aqueous liquid medium. The delayed release capsules incorporate one or more gas-relief pinholes for gas-generating water-sensitive compositions contained in the capsules, such as inorganic bleach or other alkaline compositions intended for delayed release into a wash medium during a laundry cycle. The pinholes permit gas generated within the capsule due to exposure to environmental water vapor to escape from the capsule interior, preventing pressure build-up and capsule deformation during storage. The pinholes are sized to prevent or otherwise substantially limit the passage of liquids when submerged in a liquid medium (e.g., liquid water in an aqueous liquid medium). Related articles and methods for delivering the capsules in combination with a detergent or other laundry composition are also disclosed.

48 Claims, 3 Drawing Sheets

(56) References Cited

U.S. PATENT DOCUMENTS

| | | | | |
|---|---|---|---|---|
| 2006/0079425 | A1* | 4/2006 | Kapur | C11D 3/06 510/220 |
| 2006/0243630 | A1* | 11/2006 | Bourgoin | C11D 17/042 206/524.7 |
| 2007/0219111 | A1 | 9/2007 | Ward et al. | |
| 2009/0011970 | A1 | 1/2009 | Evers | |
| 2009/0320212 | A1 | 12/2009 | Brown et al. | |
| 2010/0190677 | A1 | 7/2010 | Esposito et al. | |
| 2010/0192086 | A1 | 7/2010 | Kocienda et al. | |
| 2010/0192986 | A1 | 8/2010 | Brooker et al. | |
| 2011/0023240 | A1 | 2/2011 | Fossum et al. | |
| 2011/0186081 | A1* | 8/2011 | Dunn | B08B 3/045 134/18 |
| 2011/0189413 | A1 | 8/2011 | Denome et al. | |
| 2013/0181382 | A1* | 7/2013 | Aich | B29C 51/10 264/571 |
| 2013/0199569 | A1* | 8/2013 | Cabirol | C11D 3/33 134/18 |
| 2014/0154350 | A1* | 6/2014 | Hammond | B29C 51/30 425/403 |
| 2014/0199460 | A1 | 7/2014 | Lee et al. | |
| 2014/0315776 | A1* | 10/2014 | Krubasik | C11D 3/3707 510/439 |
| 2014/0336029 | A1* | 11/2014 | Mirle | B65D 31/12 493/267 |
| 2015/0126426 | A1 | 5/2015 | Kumar et al. | |

* cited by examiner

WATER-SOLUBLE DELAYED RELEASE CAPSULES, RELATED METHODS, AND RELATED ARTICLES

CROSS-REFERENCE TO RELATED APPLICATION

The benefit under 35 U.S.C. §119(e) of U.S. Provisional Patent Application Ser. No. 61/887,527 filed Oct. 7, 2013, is hereby claimed, and the disclosure thereof is hereby incorporated by reference herein.

FIELD OF THE DISCLOSURE

The present disclosure relates generally to cleaning compositions and to water-soluble capsules for delayed release of an active ingredient contained therein. More particularly, the disclosure relates to water-soluble capsules incorporating one or more gas-relief pinholes for gas-generating, water-sensitive compositions contained in the capsules, for example for inorganic bleach or other alkaline compositions intended for delayed release into a wash medium during a laundry cycle.

BACKGROUND

Water-soluble polymeric films are commonly used as packaging materials to simplify dispersing, pouring, dissolving and dosing of a material to be delivered. For example, packets made from water-soluble film are commonly used to package household care compositions, e.g., a pouch containing a laundry or dish detergent. A consumer can directly add the pouch to a mixing vessel, such as a bucket, sink or washing machine. Advantageously, this provides for accurate dosing while eliminating the need for the consumer to measure the composition. The pouch may also reduce mess that would be associated with dispensing a similar composition from a vessel, such as pouring a liquid laundry detergent from a bottle. The pouch also insulates the composition therein from contact with the user's hands. In sum, soluble polymeric film packets containing pre-measured agents provide for convenience of consumer use in a variety of applications.

The efficacy of certain laundry actives (e.g., enzymes) can be increased if alkaline actives (e.g., bleach additives) are introduced at a secondary stage that is delayed, for example by 15 to 20 minutes.

There remains a need for water-soluble delivery vehicles having the desired characteristics of delayed release in cold, warm, or hot laundry water, sufficient solubility as to not leave any residue on the wash load once the wash cycle is complete, chemical and physical compatibility with laundry actives, and desirable mechanical properties including good processability.

SUMMARY

The present disclosure relates generally to capsules for delayed release of an active ingredient contained therein, in particular water-soluble capsules for delayed release of water-sensitive, gas-generating compositions into an aqueous liquid medium.

Various active materials intended for delayed release into an aqueous medium are themselves water-sensitive, having a tendency to generate gas when contacted with liquid or gaseous water. For example, mixtures of sodium percarbonate and sodium carbonate suitable as inorganic bleaches in laundry applications generate gas in the presence of liquid or gaseous water, such as in humid (e.g., 80% relative humidity) and elevated temperature (e.g., 38° C.) environments. The sodium percarbonate and sodium carbonate generate hydrogen peroxide gas directly from contact with water, and the hydrogen peroxide gas can further decompose into water and oxygen gas. Such gas generation can accumulate and lead to undesirable elevated pressures within a sealed container (e.g., a capsule) holding the water-sensitive composition. Because the capsule is designed to release its water-sensitive composition at a controlled, delayed time subsequent to the capsule's addition to a liquid aqueous medium (e.g., an aqueous wash fluid in a laundry cycle), the capsule must be a barrier to water for this delay time. By making the capsule water-tight, however, the capsule also becomes air-tight, which leads to dangerous pressure build-up in the capsule in the case of active degassing, because water vapor diffusing through the capsule walls from the external environment can generate gas trapped within the capsule.

In laundry-specific embodiments such as for the delayed release of an inorganic bleach using a water-soluble polymer-based capsule system (e.g., sodium percarbonate and sodium carbonate delivered in capsule formed from a polyvinyl alcohol polymer), the capsule is desirably slow dissolving and remains functionally intact and impenetrable to bulk water for about 15-20 minutes after addition to an aqueous liquid medium at nominally 40° C. This delay time is desirable, because the efficacy of certain laundry actives (e.g., enzymes) can be increased if the more alkaline actives (e.g., inorganic bleaches) are introduced at a secondary stage that is delayed by about 15-20 minutes in a 40° C. wash cycle. In addition to delaying dissolution and active ingredient release for a desirable minimum time, the capsule is desirably sufficiently soluble to prevent residue on the wash load once the wash cycle is complete, in particular for a wash cycle of about 30 or 45 minutes to about 60 or 75 minutes (e.g., where the wash cycle can be defined as the time from the introduction of water to the beginning of the first drain/spin cycle). The capsule also is suitably chemically and physically compatible with any other laundry detergents or compositions to be added to the wash medium, whether separately from or in combination with the capsule (e.g., in a water-soluble film pouch containing both components).

In view of these problems and desirable features for the delayed release of water-sensitive active ingredients, the disclosure relates to capsules incorporating one or more gas-relief pinholes for gas-generating water-sensitive compositions contained in the capsules, in particular for inorganic bleach or other alkaline compositions intended for delayed release into a wash medium during a laundry cycle. The pinholes permit gas generated within the capsule due to exposure to environmental water vapor to escape from the capsule interior, preventing pressure build-up and capsule deformation during storage. The pinholes are sized to prevent or otherwise substantially limit the passage of liquids when submerged in a liquid medium (e.g., liquid water in an aqueous liquid medium).

The incorporation of suitably sized pinholes permits the use of a capsule delivery vehicle for delayed release applications. In laundry applications, this allows the use of cold water-soluble polymers (e.g., cold water-soluble polyvinyl alcohol grade resins) with relatively thick capsule walls (e.g., relative to thinner water-soluble film pouches) having a selected thickness to provide the desired timing for delayed release. The cold water-soluble polymers perform in a superior manner in terms of a lack of residue remaining on laundry, as compared to hot water-soluble polymer film formulations (e.g., hot water-soluble polyvinyl alcohol). In addition to not having to employ a hot water-soluble film, a protective coating (e.g., polyethylene glycol) over the bleach is not required, because the superior barrier properties of the thick capsule walls provide suitable environmental protection to its contents. Also, because the bleach does not require a protective coating, it does not need to be a solid monolithic form (e.g., a compressed tablet including the bleach and a binder), thus allowing for the use of the bleach in powder form.

One aspect of the disclosure relates to a delayed release capsule for delivery of a water-sensitive composition, the capsule including: (a) a capsule shell including a water-soluble polymer and defining an interior capsule volume, wherein: (i) the capsule shell has a wall thickness in a range of about 100 μm to about 5000 μm, and (ii) the capsule shell includes a pinhole sized and shaped (A) to permit gaseous fluid communication between the interior capsule volume and an environment external to the capsule shell, and (B) to limit liquid fluid communication between the interior capsule volume and the external environment; and (b) a water-sensitive composition contained in the interior capsule volume, the water-sensitive composition being capable of generating gas when contacted with at least one of liquid water and water vapor.

Another aspect of the disclosure relates to a delayed release capsule for delivery of a water-sensitive composition, the capsule including: (a) a water-soluble capsule shell including polyvinyl alcohol and defining an interior capsule volume, wherein: (i) the capsule shell has a wall thickness in a range of about 250 μm to about 3000 μm, and (ii) the capsule shell includes a pinhole sized and shaped (A) to permit gaseous fluid communication between the interior capsule volume and an environment external to the capsule shell, and (B) to limit liquid fluid communication between the interior capsule volume and the external environment; (b) a water-sensitive composition contained in the interior capsule volume, the water-sensitive composition (i) being capable of generating hydrogen peroxide gas when contacted with at least one of liquid water and water vapor and (ii) including an inorganic bleach selected from the group consisting of carbonate salts, borate salts, phosphate salts, sulfate salts, silicate salts, percarbonate salts, perborate salts, perphosphate salts, persulfate salts, persilicate salts, and combinations thereof; and optionally (c) at least one of a bleach activator and a bleach catalyst contained in the interior capsule volume.

In a particular refinement of the various capsule embodiments, the capsule shell can have a substantially uniform wall thickness. For example, the capsule shell wall can have a local thickness within about 50% of an average wall thickness across substantially the entire capsule shell.

Another aspect of the disclosure relates to an article including: (a) a water-soluble pouch including a water-soluble film and defining (i) an interior pouch volume and (ii) a pinhole sized and shaped to permit fluid (e.g., gas or gas and liquid) communication between the interior pouch volume and an environment external to the water-soluble pouch; (b) a delayed release capsule according to any of the variously disclosed embodiments contained in the interior pouch volume, wherein the capsule shell pinhole is in fluid communication with the water-soluble pouch pinhole; and (c) a detergent composition contained in the interior pouch volume (e.g., a laundry detergent composition, a dishwashing detergent composition, or other detergent composition).

Another aspect of the disclosure relates to a method for washing laundry, the method including: (a) forming an aqueous wash medium in a washing vessel, the aqueous wash medium including (i) water, (ii) laundry, (iii) a laundry detergent composition, and (iv) a delayed release capsule according to any of the variously disclosed embodiments, wherein the water-sensitive composition includes an inorganic bleach composition; (c) washing the laundry in the aqueous wash medium, wherein the water-sensitive composition is not released from the capsule into the aqueous wash medium until a wash cycle delay time of at least about 10 minutes is reached. In a refinement, the delayed release capsule and the laundry detergent composition can be provided to the aqueous wash medium in combination, such as in the form of the water-soluble pouch article according to any of the variously disclosed embodiments.

Another aspect of the disclosure relates to a method for delayed release of a water-sensitive composition into an aqueous liquid medium, the method including: (a) providing a delayed release capsule according to any of the variously disclosed embodiments, wherein the water-sensitive composition includes a cleaning composition (e.g., including an inorganic bleach, alone or in combination with a bleach activator and/or a bleach catalyst); (b) adding the capsule to an aqueous liquid medium comprising water; and (c) dissolving the capsule shell to release the cleaning composition into the aqueous liquid medium, wherein the cleaning composition is not released from the capsule into the aqueous liquid medium until a selected delay time is reached after addition of the capsule to the aqueous liquid medium.

Another aspect of the disclosure relates to a delayed release capsule (e.g., a free-standing capsule, with or without contents contained therein) including: a capsule shell including a water-soluble polymer and defining an interior capsule volume, wherein: (i) the capsule shell has a wall thickness in a range of about 100 μm to about 5000 μm, (ii) the capsule shell comprises a pinhole sized and shaped (A) to permit gaseous fluid communication between the interior capsule volume and an environment external to the capsule shell, and (B) to limit liquid fluid communication between the interior capsule volume and the external environment, and (iii) the capsule shell has a substantially uniform wall thickness.

Further aspects and advantages will be apparent to those of ordinary skill in the art from a review of the following detailed description and accompanying drawings. While the compositions and methods are susceptible of embodiments in various forms, the description hereafter includes specific embodiments with the understanding that the disclosure is illustrative, and is not intended to limit the invention to the specific embodiments described herein.

DESCRIPTION OF THE DRAWINGS

The following detailed description of the various disclosed methods, processes, compositions, and articles refers to the accompanying drawings in which.

DETAILED DESCRIPTION

Figure 1:
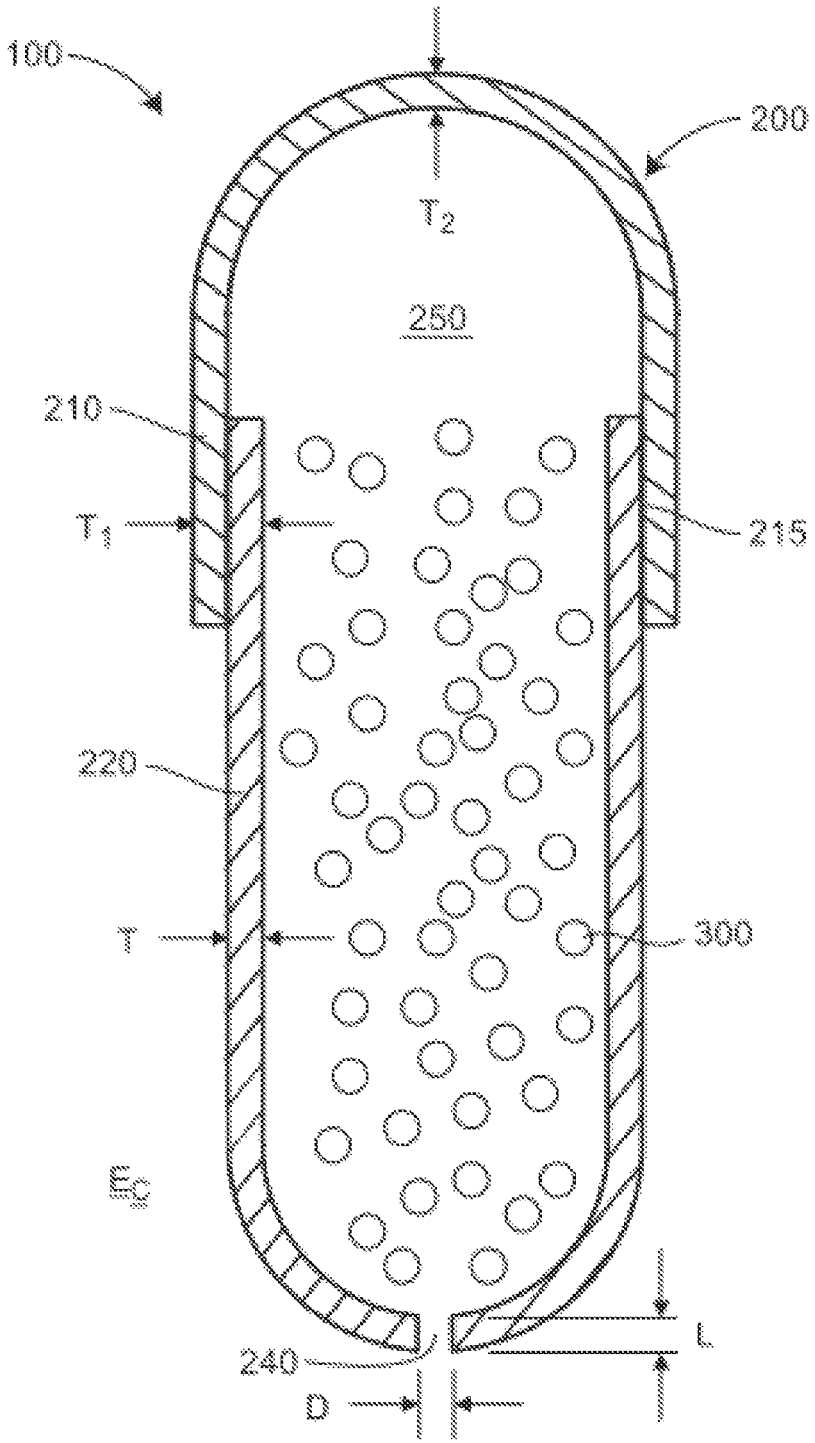
FIG. 1 is a side cross-sectional view of a delayed release capsule for delivery of a water-sensitive composition according to the disclosure.

Disclosed herein are capsules for the delayed release of active ingredients contained therein, delivery pouches containing the capsules, and related methods for using the capsules (e.g., to provide delayed release of an inorganic bleach into an aqueous laundry wash medium).

To achieve the delayed release of alkaline actives in a wash cycle, a water-soluble film packet must be slow dissolving and remain substantially intact for the 15-20 minutes at nominally 40° C. The components of the unit dose packet system must also be made to be chemically compatible with each other or chemically isolated from one another as to prevent any chemical or physical changes to the packaged materials.

Some water-soluble polymeric films that are used to make packets will incompletely dissolve during such a laundry wash cycle, leaving film residue on items within the wash, or will dissolve prematurely resulting in a decreased efficacy of certain laundry additives (e.g., enzymes) that may become unstable in the presence of other active agents.

Water-soluble polymeric films based on PVOH can be subject to changes in solubility characteristics. The acetate group in the co-poly(vinyl acetate vinyl alcohol) polymer is known by those skilled in the art to be hydrolysable by either acid or alkaline hydrolysis. As the degree of hydrolysis increases, a polymer composition made from the PVOH homopolymer resin will have increased mechanical strength but reduced solubility at lower temperatures (e.g., requiring hot water temperatures for complete dissolution). Accordingly, exposure of a PVOH homopolymer resin to an alkaline environment (e.g., resulting from a laundry bleaching additive) can transform the resin from one which dissolves rapidly and entirely in a given aqueous environment (e.g., a cold water medium) to one which dissolves slowly and/or incompletely in the aqueous environment, potentially resulting in undissolved polymeric residue at the end of a wash cycle. This is an inherent weakness in the application of films based on just the vinyl acetate/alcohol co-polymer typified by commercial PVOH homopolymer resins.

PVOH copolymer resins with pendant carboxyl groups, such as vinyl alcohol/hydrolyzed methyl acrylate sodium salt resins, can form lactone rings between neighboring pendant carboxyl and alcohol groups, thus reducing the water solubility of the PVOH copolymer resin. In the presence of a strong base such as a laundry bleaching additive, the lactone rings can open over the course of several weeks at relatively warm (ambient) and high humidity conditions (e.g., via lactone ring-opening reactions to form the corresponding pendant carboxyl and alcohol groups with increased water solubility). Thus, contrary to the effect observed with PVOH homopolymer films, it is believed that such a PVOH copolymer film can become more soluble due to chemical interactions between the film and an alkaline composition inside the pouch during storage. Consequently, as they age, the packets may become increasingly prone to premature dissolution during a hot wash cycle (nominally 40° C.), and may in turn decrease the efficacy of certain laundry actives due to the presence of the bleaching agent and the resulting pH influence.

The current state of the art in water-soluble/reactive/dispersible pouches and packets for delivering bleach with a delay relative to a laundry detergent includes the use of a multi-compartment water-soluble pouch made from polyvinyl alcohol (PVOH) film, wherein the second pouch, containing a solid, dissolves slower than the first, as is described in U.S. Pat. No. 6,727,215, and U.S. Patent Publication Nos. 2009/0011970 and 2010/0192086. Further, various different chemical coatings applied to powders of bleach or bleach activator as a means to delay release are described in U.S. Pat. Nos. 4,725,378; 5,965,505; and 5,755,992.

Commercial products which utilize PVOH film to deliver sodium carbonate and sodium percarbonate can incorporate pinhole(s) into the film surface to allow for gas to escape and maintain ambient pressure within the pouch. This is often a cautionary step as sodium percarbonate can generate oxygen gas as a byproduct of the decomposition of hydrogen peroxide which is created when the sodium percarbonate comes into contact with water or humid air and relatively warm ambient conditions. The pinhole can vary from small (microns in diameter) to comparatively larger pinholes at roughly 1 mm in diameter. However, no commercial product involving PVOH with pinholes is known to attempt delayed release of an inorganic bleach material in a nominally 40° C. water laundry application.

FIG. 1 illustrates a delayed release capsule 100 for delivery of a water-sensitive composition 300 (e.g., an inorganic bleach alone or in combination with a bleach activator and/or a bleach catalyst) according to the disclosure. The capsule 100 includes a capsule shell 200 defining an interior capsule volume 250 in which the water-sensitive composition 300 is contained. The capsule shell 200 is suitably formed from a water-soluble polymer composition, described below. As illustrated, the capsule shell 200 includes a first, right shell element 210 (e.g., top element with respect to a typical capsule filling and capping operation) and a second, left shell element 220 (e.g., bottom element with respect to a typical capsule filling and capping operation), both of which are suitably formed from a water-soluble polymer composition (e.g., the same or different polymer composition) and are generally cylindrical in shape with hemispherical enclosures at one end. The shell elements 210, 220 are sized and shaped such that they mate together (e.g., along their cylindrical axes) at a sealing interface 215 to collectively define the capsule shell 200 and the interior capsule volume 250. The capsule shell 200 has a wall thickness T, which is suitably in a range of about 100 μm to about 5000 μm. Optionally, the thickness T is substantially uniform across the entire capsule shell 200. Optionally, thickness T can vary as a function of position, for example based on the overlapping of shell elements 210, 220 (e.g., illustrated as thickness $T_1$) and/or based on specific methods of manufacturing (e.g., illustrated as an end-wall thickness $T_2$ which could be different from the sidewall thickness illustrated as T in FIG. 1).

The capsule shell 200 includes a pinhole 240. In the illustrated embodiment, the pinhole 240 is located in the hemispherical base of the first shell element 220. In other embodiments, the pinhole 240 can be located in any or multiple shell elements 210, 220 (e.g., when the capsule shell 200 includes multiple pinholes 240). Similarly, the pinhole 240 can be positioned at any desired location on the capsule shell 200 (e.g., end wall, sidewall). The pinhole 240 is illustrated as having a diameter D (e.g., representing a circular diameter for a circular pinhole or a hydraulic diameter ($D_H$) for a non-circular pinhole) and a length L (e.g., corresponding to the local capsule shell 200 wall thickness T in the neighborhood of the pinhole 240). The pinhole 240 is sized and shaped to permit gaseous fluid communication between the interior capsule volume 250 and an environment $E_c$ external to the capsule shell 200. The pinhole 240 thus allows any gas generated by the water-sensitive composition 300 upon contact with water to be released from the capsule shell 200 without substantial pressure build-up and/or damage or deformation to the shell 200. Although it permits gaseous fluid communication, the pinhole 240 is sized and shaped to limit or prevent liquid fluid communication between the interior capsule volume 250 and the external environment $E_C$. The pinhole 240 thus prevents liquid water from entering the interior capsule volume 250, for example when the capsule 100 is placed in an aqueous liquid medium (i.e., liquid entry is prevented during the delay time window until the aqueous liquid medium eventually dissolves the capsule shell 200 to release the water-sensitive composition 300 into the medium).

Figure 2:
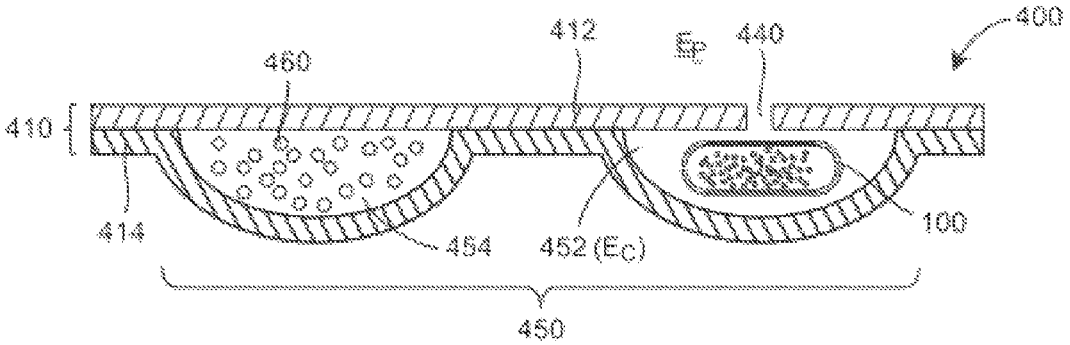
FIG. 2 is a side cross-sectional view of water-soluble pouch article for the aqueous delivery of a delayed release capsule in combination with another composition according to the disclosure.

FIG. 2 illustrates an article for the aqueous delivery of the capsule 100 in combination with another composition 460, in particular where the delivery of the capsule 100 contents 300 is to be delayed relative to the composition 460. In one class of embodiments, the capsule 100 includes an inorganic bleach, alone or in combination with a bleach activator and/or a bleach catalyst, as its water-sensitive composition 300, and the composition 460 includes one or more laundry compositions such as a detergent, a fabric softener, a bleach activator, a bleach catalyst, etc. (e.g., the bleach activator and the bleach catalyst independently can be combined with or separate from the inorganic bleach). In FIG. 2, a water-soluble pouch 400 is formed from a water-soluble film 410 (e.g., a cold water-soluble film), which is illustrated as having a first (or top) film element 412 and a second (or bottom) film element 414. The film elements 412, 414 are sealed (e.g., heat-sealed and/or solution-sealed) to define an interior pouch volume 450 containing the capsule 100 and the composition 460. The water-soluble film 410 includes a pinhole 440 sized and shaped to permit fluid communication between the interior pouch volume 450 and an environment $E_P$ external to the water-soluble pouch 400. The pouch pinhole 440 can be comparably sized to the shell pinhole 240, but it need not be resistant to liquid fluid communication, as the water-soluble film 410 relatively rapidly dissolves compared to the capsule 100, and it is the capsule 100 which provides the substantial duration of any delayed release properties for the water-sensitive composition 300.

The capsule 100 is positioned within the interior pouch volume 450 such that its pinhole 240 is in fluid communication with the water-soluble pouch pinhole 440. This permits gas generated within the interior capsule volume 250 to pass into the interior pouch volume 450 (or, equivalently, the external capsule environment $E_C$) and then into the external pouch environment $E_P$. As illustrated in FIG. 2, the film 410 can be shaped and sealed to provide physically separated first 452 and second 454 compartments of the interior pouch volume 450. The first compartment 452 defines the pouch pinhole 440 and contains the capsule 100, while the second compartment 454 contains the composition 460 and is suitably not in fluid communication with the pouch pinhole 440 or the external pouch environment $E_P$.

The capsules and capsule-containing pouches can be used in a method for washing laundry. An aqueous wash medium is first formed in a washing vessel by combining water, laundry, a laundry composition (e.g., a detergent), and a capsule according to the disclosure and including an inorganic bleach composition. The wash medium components can be added to a conventional washing machine in any desired order and in any desired relative amounts (e.g., including water, detergent, and inorganic bleach in relative amounts corresponding to manufacturer instructions depending on the type and amount of laundry to be washed). Suitably, the capsule and the laundry composition are added in combination in the form of the water-soluble pouch article described above. The laundry is then washed in the aqueous wash medium, generally at any suitable selected wash time and temperature (e.g., a wash cycle of about 30 or 45 minutes to about 60 or 75 minutes, optionally followed by a rinse cycle of about 10 or 20 minutes to about 30 or 40 minutes; a wash temperature of about 20° C., 40° C., or 60° C.). While washing, the capsule delays release of the inorganic bleach composition into the aqueous wash medium until a wash cycle delay time of at least about 10 minutes is reached (e.g., measured from the time the capsule or the capsule-containing pouch is combined with the water medium). In various embodiments, the wash cycle delay time can be at least about 10, 12, 14, or 15 minutes and/or up to about 14, 16, 18, 20, or 25 minutes. Upon completion of washing (e.g., after either or both of the wash cycle and rinse cycle), the laundry is free from visible residue (e.g., upon visual inspection) resulting from incomplete dissolution of the capsule shell.

The capsules and capsule-containing pouches more generally can be used in a method for delayed release of a water-sensitive composition into an aqueous liquid medium. A capsule according to the disclosure and including a cleaning composition (e.g., a laundry or dishwashing composition such as an inorganic bleach, alone or in combination with a bleach activator and/or a bleach catalyst) is first added to an aqueous liquid medium including water. In one aspect, the aqueous liquid medium can be an aqueous laundry wash medium formed from and including the components as described above (e.g., further including laundry and a laundry detergent composition, where the capsule includes the inorganic bleach). In another aspect, the aqueous liquid medium can be an aqueous dishwashing medium, for example including a dishwashing detergent composition in addition to the capsule (e.g., which can include the inorganic bleach and/or another delayed release dishwashing additive therein, such as a rinse aid). For example, the aqueous dishwashing medium can be formed in a wash basin of a conventional dishwashing machine washing vessel (e.g., by adding the capsule to the washing vessel directly or by adding the capsule to a compartment which releases the capsule into the washing vessel upon initiation of a wash cycle or at a predetermined phase of the wash cycle). The dishwashing medium is circulated throughout the washing vessel during a wash cycle (e.g., using pump-driven jets and gravity recycle) to contact and clean dishware (e.g., dishes, glasses, silverware, cooking utensils, cookware, and other tableware) contained in the washing vessel. Suitably, the capsule is added to the aqueous liquid medium in combination with a detergent composition (e.g., laundry detergent composition, dishwashing detergent composition), for example in the form of the water-soluble pouch article described above (e.g., with the detergent composition in one pouch compartment and the capsule in another pouch compartment). The capsule shell is then dissolved in the aqueous liquid medium to release the cleaning composition into the aqueous liquid medium, generally at any suitable selected time and temperature (e.g., in wash cycle such as a laundry or dishwashing wash cycle of about 30 or 45 minutes to about 60 or 75 minutes, optionally followed by a rinse cycle of about 10 or 20 minutes to about 30 or 40 minutes; a wash temperature of about 20° C., 40° C., or 60° C.). During dissolution, the capsule delays release of the cleaning composition into the aqueous liquid medium until a selected delay time is reached after addition of the capsule to the aqueous liquid medium (e.g., where a desired delay time can be selected for a given set of aqueous liquid medium conditions based on capsule wall thickness). In various aspects, the delay time can be at least about 10, 12, 14, or 15 minutes and/or up to about 14, 16, 18, 20, or 25 minutes. Upon completion of a cleaning cycle utilizing the capsule for delayed release of a cleaning composition (e.g., after either or both of a wash cycle and a rinse cycle), the articles being cleaned (e.g., laundry, dishware) are free from visible residue (e.g., upon visual inspection) resulting from incomplete dissolution of the capsule shell.

The disclosed capsules, delivery pouches containing the capsules, and related methods are contemplated to include embodiments including any combination of one or more of the additional optional elements, features, and steps further described below (including those shown in the figures and examples), unless stated otherwise.

In any embodiment, the capsule and/or the water-soluble pouch can contain a composition, generally a water-sensitive composition in the capsule and a different composition in the pouch. The composition can be selected from a liquid, solid or combination thereof. As used herein, "liquid" includes free-flowing liquids, as well as pastes, gels, foams and mousses. Non-limiting examples of liquids include light duty and heavy duty liquid detergent compositions, fabric enhancers, detergent gels commonly used for laundry, bleach and laundry additives. Gases, e.g., suspended bubbles, or solids, e.g. particles, may be included within the liquids. A "solid" as used herein includes, but is not limited to, powders, agglomerates, and mixtures thereof. Non-limiting examples of solids include: granules, micro-capsules, beads, noodles, and pearlised balls. Solid compositions may provide a technical benefit including, but not limited to, through-the-wash benefits, pre-treatment benefits, and/or aesthetic effects.

In any of the laundry-centric embodiments, the composition may be selected from the group of liquid light duty and liquid heavy duty liquid detergent compositions, powdered detergent compositions, fabric enhancers, detergent gels commonly used for laundry, and bleach (e.g., organic or inorganic bleach) and laundry additives, for example.

As used herein, "gaseous fluid communication" in relation to pinholes in a capsule shell and/or a capsule-enclosing water-soluble pouch denotes an opening sized to permit convective and diffusive gas mass transport across the pinhole boundary. Although the capsules and pouches disclosed herein may be formed from materials susceptible to diffusive mass transport of gaseous species across their solid boundaries into and/or out of their interior volumes, such transport is distinct from gaseous fluid communication as permitted by the pinholes.

As used herein, the term "homopolymer" generally includes polymers having a single type of monomeric repeating unit (e.g., a polymeric chain consisting of or consisting essentially of a single monomeric repeating unit). For the particular case of PVOH, the term "homopolymer" (or "PVOH homopolymer") further includes copolymers having a distribution of vinyl alcohol monomer units and vinyl acetate monomer units, depending on the degree of hydrolysis (e.g., a polymeric chain consisting of or consisting essentially of vinyl alcohol and vinyl acetate monomer units). In the limiting case of 100% hydrolysis, a PVOH homopolymer can include a true homopolymer having only vinyl alcohol units.

As used herein, the term "copolymer" generally includes polymers having two or more types of monomeric repeating units (e.g., a polymeric chain consisting of or consisting essentially of two or more different monomeric repeating units, whether as random copolymers, block copolymers, etc.). For the particular case of PVOH, the term "copolymer" (or "PVOH copolymer") further includes copolymers having a distribution of vinyl alcohol monomer units and vinyl acetate monomer units, depending on the degree of hydrolysis, as well as at least one other type of monomeric repeating unit (e.g., a ter- (or higher) polymeric chain consisting of or consisting essentially of vinyl alcohol monomer units, vinyl acetate monomer units, and one or more other monomer units). In the limiting case of 100% hydrolysis, a PVOH copolymer can include a copolymer having vinyl alcohol units and one or more other monomer units, but no vinyl acetate units.

As used herein, the term "comprising" indicates the potential inclusion of other agents, elements, steps, or features, in addition to those specified.

As used herein and unless specified otherwise, the terms "wt. %" and "wt %" are intended to refer to the composition of the identified element in "dry" (non water) parts by weight of the entire film (when applicable) or parts by weight of the entire composition enclosed within a pouch (when applicable). As used herein and unless specified otherwise, the term "phr" is intended to refer to the composition of the identified element in parts per one hundred parts water-soluble polymer (or resin; whether PVOH or otherwise) in the water-soluble film.

All ranges set forth herein include all possible subsets of ranges and any combinations of such subset ranges. By default, ranges are inclusive of the stated endpoints, unless stated otherwise. Where a range of values is provided, it is understood that each intervening value between the upper and lower limit of that range and any other stated or intervening value in that stated range, is encompassed within the disclosure. The upper and lower limits of these smaller ranges may independently be included in the smaller ranges, and are also encompassed within the disclosure, subject to any specifically excluded limit in the stated range. Where the stated range includes one or both of the limits, ranges excluding either or both of those included limits are also contemplated to be part of the disclosure.

Capsule Shell

The capsule shell 200 illustrated in FIG. 1 and described generally above is susceptible to various refinements and embodiments.

The capsule 100 and shell 200 are suitably sized to contain a unit dose of the water-sensitive composition 300 contained therein. The interior capsule volume 250 can be in a range of about 0.1 ml to about 100 ml (e.g., more generally at least about 0.1, 1, 5, 10, or 15 ml and/or up to about 10, 15, 20, 30, 50, or 100 ml), for example. Optionally, for laundry applications (e.g., to deliver inorganic bleach) as described herein and as illustrated in the examples below, the interior capsule volume 250 can be in a range of about 5 ml or 10 ml to about 30 ml or 50 ml, in addition to the values and ranges just described.

As described above, the pinhole 240 is sized and shaped both (i) to permit gaseous fluid communication between the interior capsule volume 250 and an environment $E_C$ external to the capsule shell 200 and (ii) to limit or prevent liquid fluid communication between the interior capsule volume 250 and the external environment $E_C$. By incorporating the one or more pinholes 240 in the capsule shell 200, the capsule 100 allows generated gas to escape without compromising the delayed release properties provided by the thick-wall construction of the capsule 100. The pinhole 240 can have a diameter (D; cylindrical diameter or equivalent hydraulic diameter) in a range of about 10 μm to about 1500 μm (e.g., more generally at least about 10, 50, 100, 200, or 500 μm and/or up to about 100, 200, 500, 1000, or 1500 μm), for example, to provide an effective barrier to water penetration while permitting the escape of internally generated gas. A suitable pinhole size alternatively or additionally can be expressed as a ratio of capsule wall thickness (i.e., the length L of the pinhole 240 channel) relative to the diameter D of the pinhole 240. In general, the smaller the capsule shell wall thickness T or channel length L, the smaller the pinhole diameter D that is suitable for gas-vs.-liquid selective fluid communication and vice versa. The pinhole 240 can have length (L) and a diameter (D) with a corresponding L/D ratio in a range of about 0.01, 0.2, or 1 to about 5, 10, or 100 (e.g., more generally at least about 0.01, 0.1, 0.2, 0.5, or 1 and/or up to 1, 2, 5, 10, 20, 50, or 100), for example.

In addition to the specific suitable size values for the pinhole 240 described above, the size of the pinhole 240 in a particular application can be selected based on various desired functional properties of the capsule 100. For example, the length (L), size or diameter (D), and/or the ratio L/D of the pinhole can be selected such that it is/they are sufficiently small corresponding to the size of a particulate or powder water-sensitive composition 300 contained in the capsule, thereby preventing composition 300 particles from escaping either during storage or prematurely upon addition of the capsule to an aqueous medium. Additionally or alternatively, the pinhole 240 can be sufficiently large/short to promote rapid escape of generated gas to the external environment (e.g., preventing gas accumulation and physical capsule 100 damage associated therewith). Similarly, the pinhole 240 can be sufficiently small/long to limit or prevent liquid passage from the external environment to the internal capsule volume under typical laundering conditions (e.g., pressure and temperature; such as for water or a water-like substance in terms of viscosity and density of liquid water or an aqueous laundry cleaning mixture).

The pinhole 240 can be incorporated into the capsule shell structure 200 by any suitable means. As illustrated in the examples, the pinhole 240 can be added to a capsule shell 200 by puncturing the shell 200 with a needle of desired gauge after the basic shell 200 structure has been formed. In another embodiment, the capsule shell 200 can include the pinhole 240 as originally formed. For example, a mold defining the desired wall geometry of one or more shell 200 components can include the pinhole 240 element, thus forming the pinhole 240 during molding.

The wall thickness T of the capsule shell 200 can be selected in a given application based on a desired delay time (e.g., minimum, maximum, or range) for release of the water-sensitive composition 300 and/or a maximum time by which the capsule shell 200 is completely dissolved in its release medium. The wall thickness can be in a range of about 100 μm or 250 μm to about 1500 μm or 5000 μm (e.g., more generally at least about 100, 200, 250, 500, 750 or 1000 μm and/or up to about 1000, 1250, 1500, 2500, 2500, 3800, or 5000 μm; approximate mil equivalent ranges of at least about 5, 8, 10, 20, 30 or 40 mil and/or up to about 40, 50, 60, 80, 100, 150, or 200 mil), for example. The foregoing values and ranges are suitable for capsules intended for use in delivery of inorganic bleach in laundry applications described herein. The disclosed wall thickness values and ranges can represent the average (such as surface area-average) thickness of the capsule shell 200 and/or local thickness values of the capsule shell 200 across substantially its entire surface. In cases where two or more mated shell elements collectively define the capsule shell 200, the mated shell elements can collectively satisfy properties of the capsule shell as a whole (e.g., such as wall thickness, average wall thickness, wall uniformity, etc.)

The capsule shell 200 illustrated in FIG. 1 generally has a wall thickness T; however, due to the overlapping construction at the sealing interface 215, the shell 200 has some regions of non-uniform thickness denoted by $T_1$. As illustrated in the examples below, capsules 100 having some degree of wall thickness non-uniformity can exhibit favorable delayed release and dissolution properties.

In other embodiments, the capsule shell 200 can be configured to have a substantially uniform wall thickness T. A substantially uniform wall thickness T can promote a uniform and complete disintegration of the capsule shell 200. The uniformity in total wall thickness also helps to limit the extent to which undissolved capsule shell 200 polymer is subjected to a caustic alkaline environment that can be generated as the water-sensitive composition 300 is eventually released. For the particular case of partially hydrolyzed PVOH, exposure to a basic environment can hydrolyze the undissolved PVOH resin further, rendering it relatively more insoluble, especially in cold water, and creating residue that will remain, for example at the end of a laundry wash cycle. Uniformity in the wall thickness allows the capsule wall to dissolve and thin in a uniform fashion, such that upon eventual capsule shell 100 disintegration and composition 300 release, the wall thickness of any remaining shell 200 elements is as thin as possible, thus minimizing the weight of undissolved polymer resin exposed to the caustic environment. A uniform dissolution also increases the ratio of surface area to volume of any remaining capsule shell polymer, which makes complete dissolution during the wash cycle more likely.

Substantial wall uniformity can be characterized by a capsule shell 200 wall with a local thickness T within about 50% of an average wall thickness across substantially the entire capsule shell 200 (e.g., a surface area-weighted average wall thickness), for example. More specifically, the local thickness T can be within about 1%, 2%, 5%, 10%, 20%, 30%, 40%, or 50% of the average wall thickness, for example as measured across at least 80%, 90%, 95%, 98%, or 99% of the external shell 200 surface area. In another aspect, wall uniformity can be characterized by the substantially uniform dissolution of the capsule shell 200 prior to release of contents, for example where at least 80%, 90%, 95%, 98%, or 99% of the shell mass dissolves prior to release of the water-sensitive composition 300.

Figure 3:
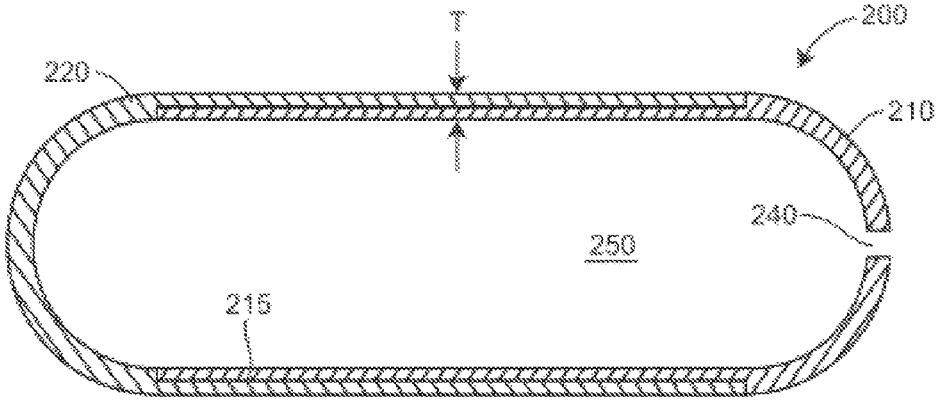
FIG. 3 is a side cross-sectional view of an embodiment of a delayed release capsule shell having a substantially uniform wall thickness according to the disclosure.
Figure 4:
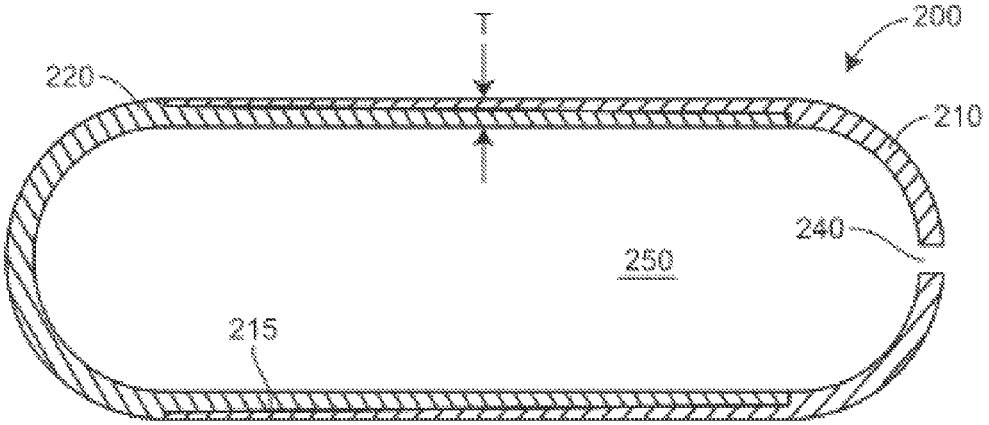
FIG. 4 is a side cross-sectional view of another embodiment of a delayed release capsule shell having a substantially uniform wall thickness according to the disclosure.
Figure 5:
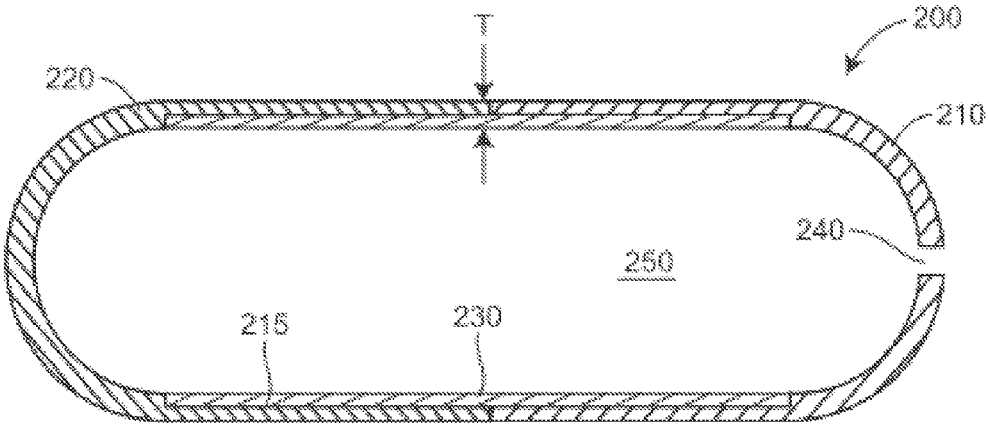
FIG. 5 is a side cross-sectional view of another embodiment of a delayed release capsule shell having a substantially uniform wall thickness according to the disclosure.

FIGS. 3-5 illustrate alternative capsule shell 200 embodiments having a substantially uniform wall thickness T.

In FIG. 3, similar to the embodiment of FIG. 1, a capsule shell 200 includes a first shell element 210 and a second shell element 220, which are fitted on to each other during manufacturing to collectively form the shell 200. As illustrated, the wall thicknesses at the hemispherical end-walls of the shell elements 210, 220 are approximately twice the wall thickness of the sidewall regions of the shell elements 210, 220. The sidewall regions, having half the thickness of the end-walls, serve as the seal area between the elements 210, 220. Once the two shell elements 210, 220 are fitted together at a sealing interface 215, the thicknesses of the sidewall regions combine to form a wall thickness which is the same as the wall thickness at the end-walls, thereby generating the capsule shell 200 with a uniform wall thickness T in its assembled form.

The embodiment of FIG. 4 is similar to that of FIG. 3 in that sidewall regions of capsule shell elements 210, 220 of a capsule shell 200 are thinner than corresponding end-wall regions. Instead of having sidewalls of uniform thickness, however, the sidewalls have a tapered thickness as a function of axial position, yet the complementary sidewalls collectively combine to form a wall thickness which is the same as the wall thickness at the end-walls, thereby generating the capsule shell 200 with a uniform wall thickness T in its assembled form.

FIG. 5 illustrates yet another embodiment in which a capsule shell 200 is formed from multiple shell elements 210, 220, 230 which collectively define a uniform wall thickness T in the assembled shell 200. In FIG. 5, the first and second shell elements 210, 220 have thinner sidewall regions as in the embodiment of FIG. 3, but they mate in the assembled shell via a third, inner cylindrical shell element 230. The inner shell element 230 can be formed from the same or different water-soluble polymer composition as the shell elements 210, 220, for example in embodiments where it is desirable to have an interior liner surface with particular chemical compatibility with the water-sensitive composition 300.

In addition to providing uniform wall thicknesses, another advantage of the embodiments of FIGS. 3-5 is that they provide a high contact surface area for the sealing area, ensuring a water-tight seal in the assembled capsules 100. The capsule shells 200 can be sealed through the friction of the high surface area of the sealing region, the use of water (or other sealing solution), or the use of surface ridges or bumps (not shown) which allow the shell elements 210, 220 to lock together once joined without compromising the water-tight seal. Moreover, if a solution such as or including water is to be used for a solution seal the shell elements 210, 220, it can be applied in such a way that it is sufficiently distant from the water-sensitive composition 300 to prevent any unintended interaction therewith (i.e., where the composition 300 would be present in the interior capsule volume 250 at the time of sealing, even though not illustrated in FIGS. 3-5).

As further shown in FIGS. 3-5, the pinhole 240 can be placed in the first (or "top") shell element 210 instead of (or in addition to) the second (or "bottom") shell element 220 as shown in FIG. 1. "Top" and "bottom" shell elements 210, 220 are relative terms reflecting the manner in which the capsule 100 is assembled in practice: The water-sensitive composition 300 is placed into the second (bottom) shell element 220, and then the first (top) shell element 210 is slidably engaged in an axial direction with the second (bottom) shell element 220 to seal the two elements 210, 220 together and define the assembled capsule 100 with the composition 300 contained therein. The placement of the pinhole 240 in the first (top) shell element 210 allows air to escape during manufacturing/assembly when the first (top) element 210 is pressed onto the second (bottom) element 220. This increases the ease and speed with which the capsules 200 can be produced, and it avoids pressurizing the interior of the capsule 100 during manufacture/assembly.

Water-Soluble Polymer Compositions

Water-soluble polymer compositions, optional ingredients for use therein, and methods of making the same are well known in the art, whether being used for making relatively thin water-soluble films as already known (e.g., as pouch materials) or relatively thick water-soluble films forming resin structures, e.g. capsules, as taught herein (e.g., as capsule materials).

In one class of embodiments, the water-soluble polymer composition includes polyvinyl alcohol (PVOH), including homopolymers thereof (e.g., including substantially only vinyl alcohol and vinyl acetate monomer units) and copolymers thereof (e.g., including one or more other monomer units in addition to vinyl alcohol and vinyl acetate units). PVOH is a synthetic resin generally prepared by the alcoholysis, usually termed hydrolysis or saponification, of polyvinyl acetate. Fully hydrolyzed PVOH, wherein virtually all the acetate groups have been converted to alcohol groups, is a strongly hydrogen-bonded, highly crystalline polymer which dissolves only in hot water—greater than about 140° F. (60° C.). If a sufficient number of acetate groups are allowed to remain after the hydrolysis of polyvinyl acetate, the PVOH polymer then being known as partially hydrolyzed, it is more weakly hydrogen-bonded and less crystalline and is soluble in cold water—less than about 50° F. (10° C.). An intermediate cold or hot water soluble polymer composition can include, for example, intermediate partially-hydrolyzed PVOH (e.g., with degrees of hydrolysis of about 94% to about 98%), and is readily soluble only in warm water—e.g., rapid dissolution at temperatures of about 40° C. and greater. Both fully and partially hydrolyzed PVOH types are commonly referred to as PVOH homopolymers although the partially hydrolyzed type is technically a vinyl alcohol-vinyl acetate copolymer.

The degree of hydrolysis (DH) of the PVOH included in the water-soluble polymer compositions of the present disclosure can be in a range of about 75% to about 99% (e.g., about 79% to about 92%, about 86.5% to about 89%, or about 88%, such as for cold-water soluble compositions). As the degree of hydrolysis is reduced, a polymer composition made from the resin will have reduced mechanical strength but faster solubility at temperatures below about 20° C. As the degree of hydrolysis increases, a polymer composition made from the polymer will tend to be mechanically stronger and the thermoformability will tend to decrease. The degree of hydrolysis of the PVOH can be chosen such that the water-solubility of the polymer is temperature dependent, and thus the solubility of a polymer composition made from the polymer, any compatibilizer polymer, and additional ingredients is also influenced. In one option the polymer composition is cold water-soluble. A cold water-soluble polymer composition, soluble in water at a temperature of less than 10° C., can include PVOH with a degree of hydrolysis in a range of about 75% to about 90%, or in a range of about 80% to about 90%, or in a range of about 85% to about 90%. In another option the polymer composition is hot water-soluble. A hot water-soluble polymer composition, soluble in water at a temperature of at least about 60° C., can include PVOH with a degree of hydrolysis of at least about 98%.

Other water soluble polymers for use in addition to or in an alternative to PVOH can include, but are not limited to modified polyvinyl alcohols, polyacrylates, water-soluble acrylate copolymers, polyvinyl pyrrolidone, polyethyleneimine, pullulan, water-soluble natural polymers including, but not limited to, guar gum, xanthan gum, carrageenan, and starch, water-soluble polymer derivatives including, but not limited to, ethoxylated starch and hydroxypropylated starch, copolymers of the forgoing and combinations of any of the foregoing. Yet other water-soluble polymers can include polyalkylene oxides, polyacrylamides, polyacrylic acids and salts thereof, celluloses, cellulose ethers, cellulose esters, cellulose amides, polyvinyl acetates, polycarboxylic acids and salts thereof, polyaminoacids, polyamides, gelatines, methylcelluloses, carboxymethylcelluloses and salts thereof, dextrins, ethylcelluloses, hydroxyethyl celluloses, hydroxypropyl methylcelluloses, maltodextrins, and polymethacrylates. Such water-soluble polymers, whether PVOH or otherwise are commercially available from a variety of sources. Any of the foregoing water-soluble polymers are generally suitable for use as film-forming polymers. Water-soluble polymers particularly suitable for the capsule shell include those that are thermally or melt processable, such as polyvinyl alcohols, polyethyleneimines, polyvinyl pyrrolidones, polyalkylene oxides, polyacrylamides, cellulose ethers, cellulose esters, cellulose amides, polyvinyl acetates, polyamides, gelatines, methylcelluloses, carboxymethylcelluloses and salts thereof, dextrins, ethylcelluloses, hydroxyethyl celluloses, hydroxypropyl methylcelluloses, maltodextrins, copolymers thereof, blends thereof, and combinations thereof. In general, the water-soluble polymer composition can include copolymers and/or blends of the foregoing resins.

The water-soluble polymers can be included in the polymer composition in an amount in a range of about 30 wt. % or 50 wt. % to about 90 wt. % or 95 wt. %, for example. The weight ratio of the amount of the water-soluble polymer as compared to the combined amount of all plasticizers, compatibilizing agents, and secondary additives can be in a range of about 0.5 to about 18, about 0.5 to about 15, about 0.5 to about 9, about 0.5 to about 5, about 1 to 3, or about 1 to 2, for example.

Water-soluble polymers for use in the polymer composition described herein (including, but not limited to PVOH polymers) can be characterized by a viscosity in a range of about 3.0 to about 27.0 cP, about 4.0 to about 23.0 cP, about 4.0 cP to about 15 cP, or about 6.0 to about 10.0 cP. The viscosity of a polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20° C. Polymeric viscosities specified herein in cP should be understood to refer to the viscosity of a 4% aqueous water-soluble polymer solution at 20° C., unless specified otherwise.

It is well known in the art that the viscosity of a water-soluble polymer (PVOH or otherwise) is correlated with the weight-average molecular weight ($\overline{M}w$) of the same polymer, and often the viscosity is used as a proxy for $\overline{M}w$. Thus, the weight-average molecular weight of the water-soluble polymer can be in a range of about 30,000 to about 175,000, or about 30,000 to about 100,000, or about 55,000 to about 80,000.

The water-soluble polymer composition can contain other auxiliary agents and processing agents, such as, but not limited to, plasticizers, plasticizer compatibilizers, surfactants, lubricants, release agents, fillers, extenders, cross-linking agents, antiblocking agents, antioxidants, detackifying agents, antifoams, nanoparticles such as layered silicate-type nanoclays (e.g., sodium montmorillonite), bleaching agents (e.g., sodium metabisulfite, sodium bisulfite or others), and other functional ingredients, in amounts suitable for their intended purposes. Embodiments including plasticizers are preferred. The amount of such agents can be up to about 50 wt. %, 20 wt %, 15 wt %, 10 wt %, 5 wt. %, 4 wt % and/or at least 0.01 wt. %, 0.1 wt %, 1 wt %, or 5 wt %, individually or collectively.

The plasticizer can include, but is not limited to, hydroxylated plasticizers such as glycerin, diglycerin, ethylene glycol, diethylene glycol, triethylene glycol, tetraethylene glycol, propylene glycol, polyethylene glycols up to 400 MW, neopentyl glycol, trimethylolpropane, polyether polyols, 2-methyl-1,3-propanediol, lactic acid, ethanolamines, and a mixture thereof. Such plasticizers (e.g., whether in liquid form at room temperature or otherwise) can be included in the water-soluble polymer composition in amounts ranging from about 10 phr or 25 phr to about 30 phr or 50 phr, about 30 phr to about 45 phr, or about 35 phr to about 40 phr, whether for a single plasticizer or a combination of plasticizers. The water-soluble polymer composition can alternatively or additionally include sugar alcohol plasticizers, for example including isomalt, maltitol, sorbitol, xylitol, erythritol, adonitol, dulcitol, pentaerythritol, mannitol and combinations thereof. The sugar alcohol plasticizers can be included in the polymer compositions in amounts ranging from about 5 phr to about 35 phr, about 5 phr to about 25 phr, about 10 phr to about 20 phr, or about 10 phr to about 15 phr, whether for a single sugar alcohol plasticizer or a combination of sugar alcohol plasticizers. The total amount of the plasticizer can be in a range of about 5 wt. % or 10 wt. % to about 30 wt. % or 40 wt. %, or about 15 wt. % to about 35 wt. %, or about 20 wt. % to about 30 wt. %, for example about 25 wt. %.

Suitable surfactants can include the nonionic, cationic, anionic and zwitterionic classes. Suitable surfactants include, but are not limited to, polyoxyethylenated polyoxypropylene glycols, alcohol ethoxylates, alkylphenol ethoxylates, tertiary acetylenic glycols and alkanolamides (nonionics), polyoxyethylenated amines, quaternary ammonium salts and quaternized polyoxyethylenated amines (cationics), and amine oxides, N-alkylbetaines and sulfobetaines (zwitterionics). Other suitable surfactants include dioctyl sodium sulfosuccinate, lactylated fatty acid esters of glycerol and propylene glycol, lactylic esters of fatty acids, sodium alkyl sulfates, polysorbate 20, polysorbate 60, polysorbate 65, polysorbate 80, lecithin, acetylated fatty acid esters of glycerol and propylene glycol, and acetylated esters of fatty acids, and combinations thereof. In various embodiments, the amount of surfactant in the water-soluble polymer composition is in a range of about 0.1 wt % to 2.5 wt %, optionally about 1.0 wt % to 2.0 wt %.

Suitable lubricants/release agents can include, but are not limited to, fatty acids and their salts, fatty alcohols, fatty esters, fatty amines, fatty amine acetates and fatty amides. Preferred lubricants/release agents are fatty acids, fatty acid salts, and fatty amine acetates. In one type of embodiment, the amount of lubricant/release agent in the water-soluble polymer composition is in a range of about 0.02 wt % to about 1.5 wt %, optionally about 0.1 wt % to about 1 wt %.

Suitable fillers/extenders/antiblocking agents/detackifying agents include, but are not limited to, starches, modified starches, crosslinked polyvinylpyrrolidone, crosslinked cellulose, microcrystalline cellulose, silica, metallic oxides, calcium carbonate, talc and mica. Preferred materials are starches, modified starches and silica. In one type of embodiment, the amount of filler/extender/antiblocking agent/detackifying agent in the water-soluble polymer composition is in a range of about 0.1 wt % to about 25 wt %, or about 1 wt % to about 10 wt %, or about 2 wt. % to about 8 wt. %, or about 3 wt. % to about 5 wt. %. In the absence of starch, one preferred range for a suitable filler/extender/antiblocking agent/detackifying agent is about 0.1 wt % or 1 wt % to about 4 wt % or 6 wt %, or about 1 wt. % to about 4 wt. %, or about 1 wt. % to about 2.5 wt. %.

The water-soluble polymer composition can further have a residual moisture content of at least 4 wt. %, for example in a range of about 4 to about 10 wt. %, as measured by Karl Fischer titration.

Other features of water-soluble polymer compositions such as films, including those comprising a capsule shell, may be found in U.S. Publication No. 2011/0189413 and U.S. application Ser. No. 13/740,053, both of which are incorporated by reference herein in their entireties.

Shaping and Sealing

The water-soluble polymer composition can be shaped into the capsule shell elements according to various processes known in the art. For example, a thermally processable water-soluble polymer can be selected and be formed by a melt processing technique (e.g., injection molding) or a thermoforming technique (described below). In a general injection molding process, the water-soluble polymer composition (e.g., including the water-soluble polymer and any additional additives such as plasticizers, etc.) for the capsule shell element is fed into a heated barrel, mixed, and forced into a mold cavity where it cools and hardens to the desired shape defined by the mold (e.g., the various shell elements 210, 220, and 230 as illustrated in the figures). Suitable melt and manifold temperatures for an injection molding process can be in a range of about 200° C. to about 220° C. (e.g., for a suitable melt processable PVOH polymer; temperatures for other water-soluble polymers can be about 10° C. to about 40° C. above the respective polymer's melting point). The barrel tip temperature can be in a range of about 250° C. to about 300° C. (e.g., about 50° C. to about 150° C. above the respective polymer's melting point). The feed section of the barrel is suitably kept cool (e.g., about 40° C.), and a typical temperature for the injection mold is about 60° C. to about 80° C. Other useful thermal processing techniques include compression molding; thermoforming of a cast sheet, fusion deposition (e.g., 3D printing), particle spraying and fusing. Examples of suitable non-thermal techniques for capsule shell formation include solvent casting (e.g., using water as the solvent) and coating processes (e.g. spray coating).

The water-soluble polymer composition also can be shaped as a film (e.g., to form a pouch containing the delayed release capsule in addition to other active ingredients) according to various processes known in the art, such as by using heat in a thermoforming process. The heat may be applied using any suitable means. For example, the film may be heated directly by passing it under a heating element or through hot air, prior to feeding it onto a surface or once on a surface. Alternatively, it may be heated indirectly, for example by heating the surface or applying a hot item onto the film. The film can be heated using an infrared light. The film may be heated to a temperature in a range of about 50 to about 150° C., about 50 to about 120° C., about 60 to about 130° C., about 70 to about 120° C., or about 60 to about 90° C. Alternatively, the film can be wetted by any suitable means, for example directly by spraying a wetting agent (including water, a solution of the film composition, a plasticizer for the film composition, or any combination of the foregoing) onto the film, prior to feeding it onto the surface or once on the surface, or indirectly by wetting the surface or by applying a wet item onto the film.

Once a film has been heated and/or wetted, it may be drawn into an appropriate mold, preferably using a vacuum. The filling of the molded film with a suitable composition (e.g., a delayed release capsule according to the disclosure, a laundry composition for use in combination therewith, etc.) can be accomplished by utilizing any suitable means. The molded film can be filled by in-line filling techniques, for example. The filled, open packets are then closed forming the pouches, using a second film, by any suitable method. This may be accomplished while in horizontal position and in continuous, constant motion. The closing may be accomplished by continuously feeding a second film, preferably water-soluble film, over and onto the open packets and then preferably sealing the first and second film together, typically in the area between the molds and thus between the packets.

Any suitable method of sealing the packet and/or the individual compartments thereof may be utilized. Non-limiting examples of such means include heat sealing, solvent welding, solvent or wet sealing, and combinations thereof. Typically, only the area which is to form the seal is treated with heat or solvent. The heat or solvent can be applied by any method, typically on the closing material, and typically only on the areas which are to form the seal. If solvent or wet sealing or welding is used, it may be preferred that heat is also applied. Preferred wet or solvent sealing/welding methods include selectively applying solvent onto the area between the molds, or on the closing material, by for example, spraying or printing this onto these areas, and then applying pressure onto these areas, to form the seal. Sealing rolls and belts as described above (optionally also providing heat) can be used, for example.

The formed water-soluble packets or pouches may then be cut by a cutting device. Cutting can be accomplished using any suitable method. It may be preferred that the cutting is also done in continuous manner, and preferably with constant speed and preferably while in horizontal position. The cutting device can, for example, be a sharp item or a hot item, whereby in the latter case, the hot item 'burns' through the film/sealing area in addition to or in the alternative to slicing. The different compartments of multi-compartment pouches may be made together in a side-by-side style wherein the resulting, conjoined pouches may or may not be separated by cutting. Alternatively, the compartments can be made separately. It should be understood that by the use of appropriate feed stations, it may be possible to manufacture multi-compartment pouches incorporating a number of different or distinctive compositions and/or different or distinctive liquid, gel or paste compositions, for example where at least one compartment contains a delayed release capsule according to the disclosure.

Water-Sensitive Compositions

As described above, the capsule of the disclosure is particularly advantageous for packaging (e.g., in direct contact with) water-sensitive compositions (e.g., alkaline materials, cleaning compositions), in particular those that generate gas (e.g., oxygen gas) when contacted with liquid water and/or water vapor (e.g., whether a room/ambient temperatures or at elevated temperatures). For example, inorganic bleaches can generate hydrogen peroxide gas upon exposure to water (liquid or gas), which in turn can decompose into water and oxygen gas. This feature of the disclosure may be utilized to keep compositions containing incompatible ingredients (e.g., water-sensitive inorganic bleaches, alone or in combination with bleach activators and/or bleach catalysts, and enzymes) physically separated or partitioned from each other. It is believed that such partitioning may expand the useful life and/or decrease physical instability of such ingredients.

Capsules made of water-soluble polymers according to the disclosure advantageously delay the release of the water-sensitive compositions contained therein, such as sodium carbonate or percarbonate bleaching agents, for at least 3, 5, or 8 minutes, as determined by Bleach Compatibility Method A (below), or at least 9, 12, or 15 minutes as determined by Bleach Compatibility Method B (below), after submersion in water heated to a temperature of 40° C., when in contact with a 1:1 mixture of sodium carbonate and percarbonate, followed by full dissolution of the capsule.

Suitable inorganic bleaches for use with the delayed release capsules include salts of carbonate, borate, phosphate, sulfate and silicate, as well as perhydrate salts such as perborate, percarbonate, perphosphate, persulfate and persilicate salts. The inorganic bleaches are normally the alkali metal salts (e.g., lithium, sodium, and/or potassium salts). The inorganic bleach suitably includes a given salt in combination with its corresponding perhydrate salt (e.g., sodium carbonate and sodium percarbonate), for example in a weight ratio of about 1:1 for the two components (e.g., about 10:1 or 5:1 to about 1:5 or 1:10 for the ratio of the given salt:perhydrate salt). The inorganic bleaches may be included as the crystalline solid without additional protection (e.g., in powder form without physical protection such as a coating on the solid particles or around an agglomerated mass of solid). Alternatively, the inorganic bleach can be coated or otherwise encapsulated, such as with a protective coating of polyethylene glycol (e.g., PEG-6000) or other coating substances known in the art. A bleach activator and/or a bleach catalyst (described below) may be included in the delayed release capsules with the inorganic bleach. Alternatively or additionally, the bleach activator and/or the bleach catalyst (when used) may be stored and/or delivered separately from the inorganic bleach (e.g., in a water-soluble pouch compartment separate from the capsule containing the inorganic bleach).

Capsules containing water-sensitive compositions can be tested for their ability to accommodate water exposure without pressure build-up or capsule deformation by storing the capsules in a controlled air environment for a period to examine their response thereto. For example, one class of water-sensitive composition can generate gas when contacted with a controlled air environment at 80% relative humidity and 38° C., which reflects an accelerated aging environment to characterize the capsule's shelf life over a prolonged period. In one class of embodiments, the capsule shell, after storage in a controlled air environment at 80% relative humidity and 38° C. for a test period of 4 weeks, does not substantially deform during the test period (e.g., there is a lack of substantial or observable ballooning during and/or at the end of the test period), although the water-sensitive composition generates gas during the test period. Such lack of deformation can be characterized by a final capsule shell interior or exterior volume or diameter that is expanded by 20%, 10%, 5%, 2%, 1% or less relative to the corresponding initial capsule shell volume or diameter.

Cleaning Compositions

In capsules or pouches comprising cleaning or detergent compositions such as laundry, laundry additive, fabric enhancer, and/or dishwashing compositions, the compositions may comprise one or more of the following non-limiting list of ingredients: fabric care benefit agent; detersive enzyme; deposition aid; rheology modifier; builder; inorganic bleach (described above), organic bleach; bleach precursor; bleach booster (or activator); bleach catalyst; perfume and/or perfume microcapsules (see for example U.S. Pat. No. 5,137,646); perfume loaded zeolite; starch encapsulated accord; polyglycerol esters; whitening agent; pearlescent agent; enzyme stabilizing systems; scavenging agents including fixing agents for anionic dyes, complexing agents for anionic surfactants, and mixtures thereof; optical brighteners or fluorescers; polymer including but not limited to soil release polymer and/or soil suspension polymer; dispersants; antifoam agents; non-aqueous solvent; fatty acid; suds suppressors, e.g., silicone suds suppressors (U.S. Publication No. 2003/0060390 A1, ¶65-77); cationic starches (US 2004/0204337 A1 and US 2007/0219111 A1); scum dispersants (US 2003/0126282 A1, ¶89-90); dyes; colorants; opacifier; antioxidant; hydrotropes such as toluenesulfonates, cumenesulfonates and naphthalenesulfonates; color speckles; colored beads, spheres or extrudates; clay softening agents. Any one or more of these ingredients is further described in described in European Patent Application Number 09161692.0, U.S. Publication Number 2003/0139312A1, and U.S. Patent Application No. 61/229,981. Additionally or alternatively, the compositions may comprise surfactants and/or solvent systems, each of which is described below.

The detergent compositions can comprise from about 1% to 80% by weight of a surfactant, for example. Detersive surfactants utilized can be of the anionic, nonionic, zwitterionic, ampholytic or cationic type or can comprise compatible mixtures of these types. In one type of embodiment, surfactants are selected from the group consisting of anionic, nonionic, and cationic surfactants, and mixtures thereof. The compositions can be substantially free of betaine surfactants. Examples of detergent surfactants useful herein are described in U.S. Pat. Nos. 3,664,961; 3,919,678; 4,222,905; and 4,239,659. In another type of embodiment surfactants are selected from the group consisting of anionic surfactants, nonionic surfactants, and combinations thereof.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants include: a) the sodium, potassium and ammonium alkyl sulfates, especially those obtained by sulfating the higher alcohols ($C_8$-$C_{18}$) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$-$C_{13}$ LAS.

Nonionic surfactants can be selected from one or more of those of the formula $R_1(OC_2H_4)_nOH$, wherein $R_1$ is a $C_{10}$-$C_{16}$ alkyl group or a $C_8$-$C_{12}$ alkyl phenyl group, and n is from 3 to about 80. Condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol, are specifically contemplated.

The solvent system in the present compositions can be a solvent system containing water alone or mixtures of organic solvents with water. Organic solvents can include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used. Solvent systems can be absent, for example from anhydrous solid embodiments of the disclosure, but more typically are present at levels in the range of from about 0.1% to about 98%, preferably at least about 1% to about 50%, more usually from about 5% to about 25%.

Organic bleaches can include organic peroxyacids including diacyl and tetraacylperoxides, especially diperoxydodecanedioc acid, diperoxytetradecanedioc acid, and diperoxyhexadecanedioc acid. The organic peroxyacid can be dibenzoyl peroxide. The diacyl peroxide, especially dibenzoyl peroxide, can be present in the form of particles having a weight average diameter of from about 0.1 to about 100 microns, preferably from about 0.5 to about 30 microns, more preferably from about 1 to about 10 microns, for example. In embodiments, at least about 25% to 100%, or at least about 50%, or at least about 75%, or at least about 90%, of the particles are smaller than 10 microns, optionally smaller than 6 microns.

Other organic bleaches include the peroxy acids, particular examples being the alkylperoxy acids and the arylperoxy acids. Representatives include: (a) peroxybenzoic acid and its ring-substituted derivatives, such as alkylperoxybenzoic acids, but also peroxy-α-naphthoic acid and magnesium monoperphthalate; (b) the aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates; and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach activators can include organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). The bleach activator can be stored and/or delivered in combination with and/or separately from its corresponding organic or inorganic bleach (e.g., in the capsule with the inorganic bleach or separate from the inorganic bleach such as in a water-soluble film packet).

Bleach catalysts for use in the detergent composition herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). Another description of bleach catalysts suitable for use herein can be found in U.S. Pat. No. 6,599,871, incorporated herein by reference. The bleach catalyst can be stored and/or delivered in combination with and/or separately from its corresponding bleach activator and organic or inorganic bleach (e.g., in the capsule with the inorganic bleach or separate from the inorganic bleach such as in a water-soluble film packet).

Builders suitable for use in the detergent composition described herein include water-soluble builders, including citrates, carbonates, silicate and polyphosphates, e.g. sodium tripolyphosphate and sodium tripolyphosphate hexahydrate, potassium tripolyphosphate and mixed sodium and potassium tripolyphosphate salts.

Enzymes suitable for use in the detergent composition described herein include bacterial and fungal cellulases including CAREZYME and CELLUZYME (Novo Nordisk A/S); peroxidases; lipases including AMANO-P (Amano Pharmaceutical Co.), M1 LIPASE and LIPOMAX (Gist-Brocades) and LIPOLASE and LIPOLASE ULTRA (Novo); cutinases; proteases including ESPERASE, ALCALASE, DURAZYM and SAVINASE (Novo) and MAXATASE, MAXACAL, PROPERASE and MAXAPEM (Gist-Brocades); α and β amylases including PURAFECT OX AM (Genencor) and TERMAMYL, BAN, FUNGAMYL, DURAMYL, and NATALASE (Novo); pectinases; and mixtures thereof. Enzymes can be added herein as prills, granulates, or cogranulates at levels typically in the range from about 0.0001% to about 2% pure enzyme by weight of the cleaning composition.

Suds suppressers suitable for use in the detergent composition described herein include nonionic surfactants having a low cloud point. "Cloud point" as used herein, is a well known property of nonionic surfactants which is the result of the surfactant becoming less soluble with increasing temperature, the temperature at which the appearance of a second phase is observable is referred to as the "cloud point." As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Low cloud point nonionic surfactants can include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants can include, for example, ethoxylated-propoxylated alcohol (e.g., BASF POLY-TERGENT SLF18) and epoxy-capped poly(oxyalkylated) alcohols (e.g., BASF POLY-TERGENT SLF18B series of nonionics, as described, for example, in U.S. Pat. No. 5,576,281).

Other suitable components for use in the detergent composition described herein include cleaning polymers having anti-redeposition, soil release or other detergency properties. Anti-redeposition polymers for use herein include acrylic acid containing polymers such as SOKALAN PA30, PA20, PA15, PA10 and SOKALAN CP10 (BASF GmbH), ACUSOL 45N, 480N, 460N (Rohm and Haas), acrylic acid/maleic acid copolymers such as SOKALAN CP5 and acrylic/methacrylic copolymers. Soil release polymers for use herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are also suitable for use in the detergent, for example diethylenetriamine penta(methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

Suitable for use in the detergent composition described herein is also a corrosion inhibitor, for example organic silver coating agents (especially paraffins such as WINOG 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands.

Other suitable components for use in the detergent composition herein include enzyme stabilizers, for example calcium ion, boric acid and propylene glycol.

Suitable rinse additives are known in the art. Commercial rinse aids for dishwashing typically are mixtures of low-foaming fatty alcohol polyethylene/polypropylene glycol ethers, solubilizers (for example cumene sulfonate), organic acids (for example citric acid) and solvents (for example ethanol). The function of such rinse aids is to influence the interfacial tension of the water in such a way that it is able to drain from the rinsed surfaces in the form of a thin coherent film, so that no water droplets, streaks, or films are left after the subsequent drying process. European Patent 0 197 434 B1 describes rinse aids which contain mixed ethers as surfactants. Rinse additives such as fabric softeners and the like are also contemplated and suitable for encapsulation in a film according to the disclosure herein.

Specific contemplated aspects of the disclosure are herein described in the following numbered paragraphs.

1. A delayed release capsule for delivery of a water-sensitive composition, the capsule comprising: (a) a capsule shell comprising a water-soluble polymer and defining an interior capsule volume, wherein: (i) the capsule shell has a wall thickness in a range of about 100 μm to about 5000 μm, and (ii) the capsule shell comprises a pinhole sized and shaped (A) to permit gaseous fluid communication between the interior capsule volume and an environment external to the capsule shell, and (B) to limit liquid fluid communication between the interior capsule volume and the external environment; and (b) a water-sensitive composition contained in the interior capsule volume, the water-sensitive composition being capable of generating gas when contacted with at least one of liquid water and water vapor.

2. The capsule of paragraph 1, wherein the interior capsule volume is in a range of about 0.1 ml to about 100 ml.

3. The capsule of any of the preceding paragraphs, wherein the wall thickness is in a range of about 250 μm to about 1500 μm.

4. The capsule of any of the preceding paragraphs, wherein the pinhole has a diameter (D) in a range of about 10 μm to about 1500 μm.

5. The capsule of any of the preceding paragraphs, wherein the pinhole has length (L) and a diameter (D) with a corresponding L/D ratio in a range of about 0.01 to about 100.

6. The capsule of any of the preceding paragraphs, wherein the capsule shell has a substantially uniform wall thickness.

7. The capsule of paragraph 6, wherein the capsule shell wall has a local thickness within about 50% of an average wall thickness across substantially the entire capsule shell.

8. The capsule of any of the preceding paragraphs, wherein: (i) the capsule shell comprises two or more capsule shell elements mated together to collectively define the capsule shell and the interior capsule volume; (ii) each capsule shell element comprises the water-soluble polymer; and (iii) at least one capsule shell element comprises the pinhole.

9. The capsule of any of the preceding paragraphs, wherein the water-soluble polymer is thermoformable.

10. The capsule of any of the preceding paragraphs, wherein the water-soluble polymer has a 4% solution viscosity at 20° C. in a range of about 4 cP to about 23 cP.

11. The capsule of any of the preceding paragraphs, wherein the water-soluble polymer is selected from the group consisting of polyvinyl alcohols, polyethyleneimines, polyvinyl pyrrolidones, polyalkylene oxides, polyacrylamides, cellulose ethers, cellulose esters, cellulose amides, polyvinyl acetates, polyamides, gelatines, methylcelluloses, carboxymethylcelluloses and salts thereof, dextrins, ethylcelluloses, hydroxyethyl celluloses, hydroxypropyl methylcelluloses, maltodextrins, copolymers thereof, blends thereof, and combinations thereof.

12. The capsule of any of the preceding paragraphs, wherein the water-soluble polymer comprises polyvinyl alcohol.

13. The capsule of paragraph 12, wherein the polyvinyl alcohol has a degree of hydrolysis in a range of about 75% to about 99%.

14. The capsule of paragraph 12, wherein the polyvinyl alcohol comprises a polyvinyl alcohol copolymer consisting essentially of vinyl alcohol monomeric repeat units and vinyl acetate monomeric repeat units.

15. The capsule of paragraph 12, wherein the polyvinyl alcohol comprises a polyvinyl alcohol copolymer comprising vinyl alcohol monomeric repeat units, vinyl acetate monomeric repeat units, and at least one other type of monomeric repeat units.

16. The capsule of any of the preceding paragraphs, wherein the capsule shell as formed remains intact for at least about 8 minutes when submerged in water heated to a temperature of about 40° C., as measured by Bleach Compatibility Method A.

17. The capsule of any of the preceding paragraphs, wherein the capsule shell as formed remains intact for at least about 12 minutes when submerged in water heated to a temperature of about 40° C., as measured by Bleach Compatibility Method A.

18. The capsule of any of the preceding paragraphs, wherein the capsule shell as formed remains intact for at least about 15 minutes when submerged in water heated to a temperature of about 40° C., as measured by Bleach Compatibility Method B.

19. The capsule of any of the preceding paragraphs, wherein the capsule leaves no visible residue on laundry when washed with laundry for 61 minutes in an unheated wash cycle at a temperature in a range of about 20° C. to about 25° C.

20. The capsule of any of the preceding paragraphs, wherein the capsule leaves no visible residue on laundry when (i) washed with laundry for 61 minutes in an unheated wash cycle at a temperature in a range of about 20° C. to about 25° C. and then (ii) rinsed at a temperature in a range of about 20° C. to about 25° C. with laundry for 36 minutes.

21. The capsule of any of the preceding paragraphs, wherein the water-sensitive composition is capable of generating oxygen gas when contacted with at least one of liquid water and water vapor.

22. The capsule of any of the preceding paragraphs, wherein the water-sensitive composition generates gas when contacted with a controlled air environment at 80% relative humidity and 38° C.

23. The capsule of any of the preceding paragraphs, wherein: (i) the water-sensitive composition generates gas when contacted with a controlled air environment at 80% relative humidity and 38° C. for a test period of 4 weeks; and (ii) the capsule shell does not substantially deform during the test period.

24. The capsule of any of the preceding paragraphs, wherein the water-sensitive composition is alkaline.

25. The capsule of any of the preceding paragraphs, wherein the water-sensitive composition comprises an inorganic bleach selected from the group consisting of carbonate salts, borate salts, phosphate salts, sulfate salts, silicate salts, percarbonate salts, perborate salts, perphosphate salts, persulfate salts, persilicate salts, and combinations thereof.

26. The capsule of paragraph 25, wherein the inorganic bleach composition comprises sodium percarbonate and sodium carbonate.

27. The capsule of any of the preceding paragraphs, wherein the water-sensitive composition comprises an inorganic bleach and at least one of a bleach activator and a bleach catalyst.

28. The capsule of any of the preceding paragraphs, wherein the water-sensitive composition is in a powder form.

29. The capsule of any of the preceding paragraphs, wherein the water-sensitive composition is uncoated.

30. A delayed release capsule for delivery of a water-sensitive composition, the capsule comprising: (a) a water-soluble capsule shell comprising polyvinyl alcohol and defining an interior capsule volume, wherein: (i) the capsule shell has a wall thickness in a range of about 250 μm to about 3000 μm, and (ii) the capsule shell comprises a pinhole sized and shaped (A) to permit gaseous fluid communication between the interior capsule volume and an environment external to the capsule shell, and (B) to limit liquid fluid communication between the interior capsule volume and the external environment; and (b) a water-sensitive composition contained in the interior capsule volume, the water-sensitive composition (i) being capable of generating hydrogen peroxide gas when contacted with at least one of liquid water and water vapor and (ii) comprising an inorganic bleach selected from the group consisting of carbonate salts, borate salts, phosphate salts, sulfate salts, silicate salts, percarbonate salts, perborate salts, perphosphate salts, persulfate salts, persilicate salts, and combinations thereof. The delayed release capsule of paragraph 30 can be refined or extended as described in any of the preceding paragraphs.

31. The capsule of paragraph 30, wherein the capsule shell has a substantially uniform wall thickness in a range of about 250 μm to about 1500 μm.

32. The capsule of paragraph 30 or 31, wherein the water-sensitive composition further comprises at least one of a bleach activator and a bleach catalyst.

33. An article comprising: (a) a water-soluble pouch comprising a water-soluble film and defining (i) an interior pouch volume and (ii) a pinhole sized and shaped to permit fluid communication between the interior pouch volume and an environment external to the water-soluble pouch; (b) the capsule according to any of the preceding paragraphs contained in the interior pouch volume, wherein the capsule shell pinhole is in fluid communication with the water-soluble pouch pinhole; and (c) a laundry detergent composition contained in the interior pouch volume.

34. The article of paragraph 33, wherein: (i) the interior pouch volume comprises at least (A) a first compartment and (B) a second compartment physically separated from the first compartment; (ii) the first compartment defines the pouch pinhole and contains the capsule; and (iii) the second compartment contains the laundry detergent composition.

35. The article of paragraph 33 or 34, wherein the water-soluble film comprises a water-soluble polymer, which can be the same as or different from the water-soluble polymer of the capsule shell.

36. A method for washing laundry, the method comprising: (a) forming an aqueous wash medium in a washing vessel, the aqueous wash medium comprising (i) water, (ii) laundry, (iii) a laundry detergent composition, and (iv) the capsule according to any of the preceding paragraphs, wherein the water-sensitive composition comprises an inorganic bleach composition; (c) washing the laundry in the aqueous wash medium, wherein the water-sensitive composition is not released from the capsule into the aqueous wash medium until a wash cycle delay time of at least about 10 minutes is reached.

37. The method of paragraph 36, wherein the capsule and the laundry detergent composition are added to the washing vessel in the form of the article of any one of paragraphs 33 to 35.

38. The method of paragraph 36 or 37, wherein the laundry upon completion of washing is free from visible residue resulting from dissolution of the capsule shell.

39. The method of any one of paragraphs 36 to 38, wherein the wash cycle delay time is at least about 15 minutes.

40. A method for delayed release of a water-sensitive composition into an aqueous liquid medium, the method comprising: (a) providing the capsule according to any of the preceding paragraphs, wherein the water-sensitive composition comprises a cleaning composition; (b) adding the capsule to an aqueous liquid medium comprising water; and (c) dissolving the capsule shell to release the cleaning composition into the aqueous liquid medium, wherein the cleaning composition is not released from the capsule into the aqueous liquid medium until a selected delay time is reached after addition of the capsule to the aqueous liquid medium.

41. The method of paragraph 40, wherein the delay time is at least about 10 minutes.

42. The method of paragraph 40, wherein the delay time is at least about 15 minutes.

43. A delayed release capsule comprising: a capsule shell comprising a water-soluble polymer and defining an interior capsule volume, wherein: (i) the capsule shell has a wall thickness in a range of about 100 μm to about 5000 μm, (ii) the capsule shell comprises a pinhole sized and shaped (A) to permit gaseous fluid communication between the interior capsule volume and an environment external to the capsule shell, and (B) to limit liquid fluid communication between the interior capsule volume and the external environment, and (iii) the capsule shell has a substantially uniform wall thickness. The delayed release capsule of paragraph 43 can be refined or extended as described in any of the preceding paragraphs.

44. The capsule of paragraph 43, wherein the interior capsule volume is in a range of about 0.1 ml to about 100 ml.

45. The capsule of any one of paragraphs 43 or 44, wherein the wall thickness is in a range of about 250 μm to about 1500 μm.

46. The capsule of any one of paragraphs 43 to 45, wherein the pinhole has a diameter (D) in a range of about 10 μm to about 1500 μm.

47. The capsule of any one of paragraphs 43 to 46, wherein the pinhole has length (L) and a diameter (D) with a corresponding L/D ratio in a range of about 0.01 to about 100.

48. The capsule of any one of paragraphs 43 to 47, wherein the capsule shell wall has a local thickness within about 50% of an average wall thickness across substantially the entire capsule shell.

49. The capsule of any one of paragraphs 43 to 48, wherein: (i) the capsule shell comprises two or more capsule shell elements mated together to collectively define the capsule shell and the interior capsule volume; (ii) each capsule shell element comprises the water-soluble polymer; and (iii) at least one capsule shell element comprises the pinhole.

EXAMPLES

Bleach Compatibility Method A (Method A) Test

A water-soluble article to be tested for delayed release, solubility, and/or inorganic bleach compatibility characteristics (e.g., a capsule according to the disclosure, a water-soluble pouch, or otherwise) is loaded with either 5.8 g of 1:1 (wt %) sodium carbonate and sodium percarbonate mixed powder or a 10 g compressed tablet of the same material, and sealed. The compressed bleach tablets can comprise stearic acid as a binding agent and are made with compression techniques well known to those skilled in the art. Suitable bleach powder materials are available from Solvay Chemicals. The article is secured using a vinyl coated 0.5-inch (12.7 mm) metal mesh cage and submerged into a 600 ml beaker containing 500 ml of 40° C. deionized water, with stirring. The water is adjusted to pH 7 before submerging the metal mesh cage containing the article. After the pouch is submerged, the pH of the water is monitored using a pH probe and recorded every minute until a pH of 9.5 or higher is reached, or until 20 minutes have elapsed. The integrity and dissolution behavior of the article is observed and recorded.

Suitable behavior in 40° C. water for the delayed release capsules disclosed herein is marked by a sudden increase in pH through the release of the active materials from the article at about 8 minutes or later from the start of the test (i.e., submerging of the article). More generally, the capsule shell remains intact for at least 8, 10, 12, or 14 minutes and/or up to 12, 14, 16, 18, or 20 minutes according to the test of Method A. Desirable release times can relate to a capsule as initially manufactured (i.e., as formed), and/or they can reflect a capsule stored under controlled 80% RH and 38° C. environments for test periods such as 2 weeks or 4 weeks, for example. Such behavior for Method A can correspond to an active release delay of about 15 to 20 minutes within a commercially-available automatic laundry machine cycle using nominally 40° C. wash water.

Bleach Compatibility Method B (Method B) Test

The delayed release, solubility, and/or bleach compatibility characteristics of water-soluble articles prepared from water-soluble polymers are tested in a Siemens S16-79 washing machine using the program Koch/Bunt (cotton/colored), or an equivalent. The SIEMENS brand S16-79 automatic washing machine has a 65 liter drum capacity and variable temperature selection. The test samples are prepared as described above for Bleach Compatibility Method A. The temperature of the wash water is either 20° C., 40° C., or 60° C. The water hardness is 250 ppm $CaCO_3$ (14° d, German degrees hardness). The wash load is 3 kg, consisting of 2 bed sheets (1.5×1.5 m ISO 2267), 4 pillow cases (0.8×0.8 m ISO 2267), and 3 huckaback towels, cotton bleached. The dissolution time for Method B corresponds to the time at which a pH of 9.5 or higher is reached, as measured by a pH probe. Suitable behavior is marked by a sudden increase in pH through the release of the active materials from the pouch at about 10, 12, or 15 to about 15, 20, or 25 minutes within a commercially-available automatic laundry machine cycle using nominally 40° C. wash water. Desirable release times can relate to a capsule as initially manufactured (i.e., as formed), and/or they can reflect a capsule stored under controlled 80% RH and 38° C. environments for test periods such as 2 weeks or 4 weeks, for example.

Laundry Residue Test

The water-solubility and tendency to leave laundry residue for articles prepared from water-soluble polymers are tested in a MIELE brand W3033 front-loading washing machine, or an equivalent, with a 71-liter drum capacity and variable temperature selection. The temperature of the wash water is nominally 20° C. (or unheated), 40° C., or 60° C. A standard wash load is about 2.9 kg, consisting of 4 hand towels (cotton), 2 bath towels (cotton), 4 pillow cases (cotton or cotton/PET blend), and 1 queen flat sheet (cotton or cotton/PET blend). A light wash load is about 1.9 kg, consisting 1 bath towel and 1 pillow case. A heavy wash load is about 3.7 kg, consisting of 4 hand towels, 3 bath towels, 4 pillow cases, and 1 queen flat sheet. Test articles are prepared as described above for Bleach Compatibility Method A, and one article is placed in a closed pillow case (tied with a knot) for each wash load tested. A conventional wash cycle is then performed for about 61 minutes, optionally followed by rinse cycle of about 36 minutes. At the end of the wash cycle, rinse cycle, or both, the laundry is removed from the washing machine and visibly inspected for the presence of residue (e.g., non-solubilized capsule shell or pouch film polymer), whether on the enclosing pillow case or otherwise. A visible absence of any residue is a desirable water-solubility characteristic for typical laundry wash temperatures.

Suitable behavior in laundry environment for the delayed release capsules disclosed herein is marked by capsules which leave no visible residue (e.g., based on visual inspection) on laundry when washed with laundry (e.g., with a small, standard, or large reference wash load) for 61 minutes in an unheated wash cycle at a temperature in a range of about 20° C. to about 25° C. as described above. Alternatively or additionally, the capsules suitably leave no visible residue on laundry when (i) washed with laundry (e.g., with a small, standard, or large reference wash load) for 61 minutes in an unheated wash cycle at a temperature in a range of about 20° C. to about 25° C. and then (ii) rinsed at a temperature in a range of about 20° C. to about 25° C. with laundry for 36 minutes.

Example 1

Delayed Release Capsule

A capsule according to the disclosure and substantially as illustrated in FIG. 1 was formed to evaluate its storage stability, delayed release properties, and solubility properties. The capsule shell was formed from two mating shell elements formed by injection molding a PVOH homopolymer composition. The PVOH homopolymer composition included about 80 wt. % to 90 wt. % of a cold water-soluble PVOH homopolymer (8 cP solution viscosity, 88% degree of hydrolysis), about 9 wt. % to 15 wt. % of a water-soluble hydroxylated plasticizer, and about 0.5 wt. % to 2 wt. % of minor additives such as lubricants, release agents, fillers, extenders, antiblocking agents, and detackifying agents. The shell elements had a nominal wall thickness of about 35 mil (890 μm), although the end-wall portions of the shell elements had relatively thinner walls of about 28 mil (710 μm; denoted by $T_2$ in FIG. 1). A 1:1 (by weight) mixture of sodium percarbonate and sodium carbonate (5.8 g total) was added to the capsule bottom, which was then capped and water-sealed with the capsule top. The assembled capsule had an outer diameter of about 22 mm OD and height of about 55 mm. The bottom portion of the capsule was then punctured with a 22.5-gauge needle to provide a pinhole with a diameter of about 700 μm and a corresponding aspect ratio (L/D) of about 1.

Comparative Examples 2-3

Inorganic Bleach Pouch

Comparative Examples 2 and 3 include a 4 mil-thick water-soluble film pouch formed from a PVOH homopolymer using a conventional thermoforming technique. The pouches were filled with a 10 g-tablet of sodium percarbonate and sodium carbonate (1:1 by weight) as an inorganic bleach and then sealed. In Comparative Example 2, the inorganic bleach tablet had a coating of PEG-6000 with a thickness of about 20 mil, generally in a range of 15 mil to 25 mil. In Comparative Example 3, the inorganic bleach tablet was uncoated.

Example 4, Comparative Examples 5-6

Pouch/Capsule/Bleach Article

Example 4 includes a 3 mil-thick water-soluble film pouch formed from a PVOH copolymer using a conventional thermoforming technique. A delayed-release capsule according to Example 1 (including the inorganic bleach) was placed inside the pouch before sealing. The pouch was then punctured with a 22.5 gauge needle to provide a pinhole (about 700 μm in diameter) in the pouch sidewall, which pinhole provided gaseous fluid communication to the pouch interior with both (i) the external environment to the pouch and (ii) and the interior capsule volume via the capsule shell pinhole. The resulting pouch/capsule/inorganic bleach article generally corresponded to the right side of the pouch 400 as illustrated in FIG. 2 (i.e., including the capsule 100 but without the second compartment 454 containing the detergent 460).

Comparative Example 5 was the same as Example 4, except that there was no pinhole formed in the pouch sidewall. Accordingly, there was gaseous fluid communication to the pouch interior with only the interior volume of the capsule shell, but not with the external environment to the pouch.

Comparative Example 6 was the same as Example 4, except that there was no pinhole formed in either of the capsule shell or the pouch sidewall. Accordingly, there was no gaseous fluid communication to the pouch interior with either (i) the interior volume of the capsule shell, or (ii) the external environment to the pouch.

Example 7

Gas Generation Test Results

The pouch/capsule/inorganic bleach articles of Example 4 and Comparative Examples 5-6 (three replicates of each) of pouch/capsule combinations were stored in a controlled environment at 80% relative humidity and 38° C. for 4 weeks. The examples illustrate the effect of water vapor permeating from the external environment through the water-soluble polymer walls and pinholes (when present) into the interior capsule volume, where the water vapor contacted the inorganic bleach composition to liberate hydrogen peroxide gas and correspondingly generate oxygen gas and additional water vapor. Ballooning (i.e., volumetric expansion or distortion) of the pouch and/or capsule resulting from water-induced gas generation is undesirable because it can lead to physical destruction of the pouch and/or capsule during storage. Such physical damage can reduce the useful shelf life of the article, such as by allowing the contents of the pouch and/or capsule (e.g., laundry detergent, inorganic bleach, or other composition) to leak or escape from the originally sealed article and/or by altering/eliminating the delayed release properties of the capsule (e.g., by causing the capsule contents to be released either immediately or substantially earlier than intended when introduced into an aqueous liquid medium). Furthermore, even if the extent of ballooning does not lead to any functional defect, such as physical destruction of a capsule or pouch, it can lead to undesirable consumer acceptance, e.g., an impression of a product defect.

Table 1 below presents the results from the water-induced gas generation test. From Table 1, it is seen that within 4 weeks at 38° C./80% RH, the combination of pinholes in both the capsule shell and the enveloping pouch prevented ballooning altogether, such that neither the capsule nor the pouch exhibited any visible expansion or volumetric distortion (Example 4). This result illustrates the ability of the capsule and pouch to maintain structural integrity during storage and to preserve the delayed release properties of the capsule. In contrast, the absence of at least one of the two pinholes in the control samples resulted in either the capsule or the pouch ballooning (Comparative Examples 5-6). Such ballooning illustrates the permeability of the articles to atmospheric water, even in the absence of pinholes, the susceptibility to excessive gas (oxygen) generation, and the risk of product destruction/degradation. Although Comparative Example 5 exhibits ballooning of the pouch, it nonetheless illustrates favorable behavior with respect to the capsule, which included a pinhole for generated gas relief, because the capsule of Comparative Example 5 maintained its shape and structural integrity during storage, notwithstanding the ballooning of the pouch external to the capsule.

TABLE 1

Gas Generation Test Results

| Sample | Replicate | Observation |
|---|---|---|
| Example 4 | 1 | No ballooning of capsule, no ballooning of pouch |
| | 2 | No ballooning of capsule, no ballooning of pouch |
| | 3 | No ballooning of capsule, no ballooning of pouch |
| Comp. Ex. 5 | 1 | No ballooning of capsule, ballooning of pouch |
| | 2 | No ballooning of capsule, ballooning of pouch |
| | 3 | No ballooning of capsule, ballooning of pouch |
| Comp. Ex. 6 | 1 | Heavy ballooning capsule, no ballooning of pouch |
| | 2 | No ballooning of capsule, heavy ballooning of pouch |
| | 3 | No ballooning of capsule, ballooning of pouch |

Example 8

Bleach Compatibility Method A Results

Inorganic bleach capsules according to Example 1 and inorganic bleach pouches according to Comparative Example 2 were tested for their delayed release properties as represented by Bleach Compatibility Method A to determine the amount of time required to reach a pH value of 9.5 in water at 40° C. (see above). The capsules were tested (i) as originally formed, (ii) after periods of n=2, 4, and 6 weeks in ambient storage conditions (room temperature and uncontrolled humidity; denoted as "Amb(n)"), and (iii) after periods of n=2, 4, and 6 weeks in controlled storage environment at 38° C. and 80% relative humidity (denoted as "38/80(n)"). The pouches were tested as originally formed.

Table 2 below presents the results from the Bleach Compatibility Method A test. As seen from Table 2, it was unexpectedly found that the presence of the pinhole in the capsule shell of Example 1 did not destroy the delayed release properties of the capsule (e.g., by premature dissolution of the capsule and/or by allowing the capsule's contents to be prematurely released through the pinhole). Moreover, the data show relatively consistent delayed release properties over an extended period, whether stored at ambient or controlled conditions.

TABLE 2

Bleach Compatibility Method A Results

| Bleach Delivery Vehicle | Storage Period | Time to pH of 9.5 |
|---|---|---|
| Example 1 | As formed | 13.0 minutes |
| | Amb(2) | 14.3 minutes |
| | Amb(4) | 14.5 minutes |

TABLE 2-continued

Bleach Compatibility Method A Results

| Bleach Delivery Vehicle | Storage Period | Time to pH of 9.5 |
|---|---|---|
| | Amb(6) | 14.1 minutes |
| | 38/80(2) | 12.7 minutes |
| | 38/80(4) | 15.3 minutes |
| | 38/80(6) | 9.35 minutes |
| Comparative Example 2 | As formed | 8.6 minutes |

Experimentally, it was visually observed that the capsule shell tended to release its inorganic bleach powder through the bottom portion of the capsule, resulting from the relatively thinner wall thickness (about 7 mil (178 μm)) in the bottom portion. Accordingly, it is contemplated that improved dissolution uniformity can be obtained with a capsule shell design having a substantially uniform wall thickness. Further, the wall thickness can be increased or decreased to increase or decrease, respectively, the release or dissolution time of the capsule for a given application (e.g., as represented by either the Method A or Method B compatibility tests).

Example 9

Capsule Dissolution/Residue Test Results

Inorganic bleach capsules according to Example 1 and inorganic bleach pouches according to Comparative Examples 2-3 were tested for their ability to dissolve and avoid residue on laundry in a typical wash cycle as represented by the Laundry Residue Test (see above). The capsules were tested (i) as originally formed, (ii) after periods of n=2, 4, and 6 weeks in ambient storage conditions (room temperature and uncontrolled humidity; denoted as "Amb (n)"), and (iii) after periods of n=2, 4, and 6 weeks in controlled storage environment at 38° C. and 80% relative humidity (denoted as "38/80(n)"). The pouches were tested as originally formed. The articles were variously added to a small, standard, or large wash load and were subjected to an unheated (nominally 20° C.), warm (nominally 40° C.), or hot (nominally 60° C.) 61-minute wash cycle followed by a 31-minute rinse cycle. The actual wash cycle temperature was measured and recorded (noted in Table 3 below in parentheses), and the visible presence or absence of residue was noted both at the end of the wash cycle and prior to the rinse cycle ("post wash"), and at the end of the rinse cycle ("post rinse").

Table 3 below presents the results from the Laundry Residue Test. As seen from Table 3, it was found that the delayed release capsules according to the disclosure (Example 1) generally did not leave laundry residue after a rinse cycle, except under the most extreme accelerated aging conditions (38° C./80% RH for 6 weeks). This feature was notable due to the substantially thicker walls of the capsule shells as compared to the thin films of Comparative Example 2 with PEG-coated inorganic bleach.

TABLE 3

Laundry Residue Test Results

| Bleach | | Wash | | Degree of Laundry Residue | |
|---|---|---|---|---|---|
| Vehicle | Storage | Load | Wash Heat | Post-Wash | Post-Rinse |
| Example 1 | As formed | Standard | None (24° C.) | 0-None | 0-None |
| | Amb(2) | Standard | None (24° C.) | 0-None | 0-None |
| | Amb(4) | Standard | None (24° C.) | 1-Occasional | 0-None |
| | Amb(6) | Standard | None (24° C.) | 2-Consistent | 0-None |
| | 38/80(2) | Standard | None (24° C.) | 1-Occasional | 0-None |

TABLE 3-continued

| Laundry Residue Test Results | | | | | |
|---|---|---|---|---|---|
| Bleach | | Wash | | Degree of Laundry Residue | |
| Vehicle | Storage | Load | Wash Heat | Post-Wash | Post-Rinse |
| | 38/80(4) | Standard | None (24° C.) | 1-Occasional | 0-None |
| | 38/80(6) | Standard | None (24° C.) | 2-Consistent | 2-Consistent |
| | As formed | Small | None (24° C.) | 0-None | 0-None |
| | As formed | Large | None (24° C.) | 2-Consistent | 0-None |
| | As formed | Standard | Warm (35° C.) | 0-None | 0-None |
| | As formed | Large | Warm (35° C.) | 0-None | 0-None |
| Comparative Example 2 | As formed | Standard | Warm (35° C.) | 0-None | 0-None |
| Comparative Example 3 | As formed | Standard | None (24° C.) | 3-Substantial | 3-Substantial |
| | As formed | Standard | Warm (31° C.) | 1-Occasional | 0-None |
| | As formed | Large | Warm (31° C.) | 3-Substantial | 3-Substantial |

Laundry Residue Key:
0-Complete absence of any residue upon visual inspection;
1-Small, insubstantial residue occasionally visually noted;
2-Small, insubstantial residue consistently visually noted; and
3-Substantial residue consistently visually noted The foregoing description is given for clearness of understanding only, and no unnecessary limitations should be understood therefrom, as modifications within the scope of the invention may be apparent to those having ordinary skill in the art.

Throughout this specification and the claims which follow, unless the context requires otherwise, the word "comprise" and variations such as "comprises" and "comprising" will be understood to imply the inclusion of a stated integer or step or group of integers or steps but not the exclusion of any other integer or step or group of integers or steps.

Throughout the specification, where compositions are described as including components or materials, it is contemplated that the compositions can also consist essentially of, or consist of, any combination of the recited components or materials, unless described otherwise. Likewise, where methods are described as including particular steps, it is contemplated that the methods can also consist essentially of, or consist of, any combination of the recited steps, unless described otherwise. The invention illustratively disclosed herein suitably may be practiced in the absence of any element or step which is not specifically disclosed herein.

The practice of a method disclosed herein, and individual steps thereof, can be performed manually and/or with the aid of or automation provided by electronic equipment. Although processes have been described with reference to particular embodiments, a person of ordinary skill in the art will readily appreciate that other ways of performing the acts associated with the methods may be used. For example, the order of various of the steps may be changed without departing from the scope or spirit of the method, unless described otherwise. In addition, some of the individual steps can be combined, omitted, or further subdivided into additional steps.

All patents, publications and references cited herein are hereby fully incorporated by reference. In case of conflict between the present disclosure and incorporated patents, publications and references, the present disclosure should control.

What is claimed:

1. A delayed release capsule for delivery of a water-sensitive composition, the capsule comprising:

(a) a capsule shell comprising a water-soluble polymer and defining an interior capsule volume, wherein:

(i) the capsule shell has a wall thickness in a range of about 500 μm to about 5000 μm, (ii) the capsule shell comprises a pinhole sized and shaped (A) to permit gaseous fluid communication between the interior capsule volume and an environment external to the capsule shell, and (B) to limit liquid fluid communication between the interior capsule volume and the external environment, (iii) the capsule shell comprises two or more capsule shell elements mated together in a slidable engagement to collectively define the capsule shell and the interior capsule volume, (iv) each capsule shell element comprises the water-soluble polymer, and (v) at least one capsule shell element comprises the pinhole; and (b) a water-sensitive composition contained in the interior capsule volume and in contact with the capsule shell wall, the water-sensitive composition being capable of generating gas when contacted with at least one of liquid water and water vapor.

2. The capsule of claim 1, wherein the interior capsule volume is in a range of about 0.1 ml to about 100 ml.

3. The capsule of claim 1, wherein the wall thickness is in a range of about 500 μm to about 1500 μm.

4. The capsule of claim 1, wherein the pinhole has a diameter (D) in a range of about 10 μm to about 1500 μm.

5. The capsule of claim 1, wherein the pinhole has length (L) and a diameter (D) with a corresponding L/D ratio in a range of about 0.01 to about 100.

6. The capsule of claim 1, wherein the capsule shell has a substantially uniform wall thickness.

7. The capsule of claim 1, wherein the water-soluble polymer is thermoformable.

8. The capsule of claim 1, wherein the water-soluble polymer has a 4% solution viscosity at 20° C. in a range of about 4 cP to about 23 cP.

9. The capsule of claim 1, wherein the water-soluble polymer is selected from the group consisting of polyvinyl alcohols, polyethyleneimines, polyvinyl pyrrolidones, polyalkylene oxides, polyacrylamides, cellulose ethers, cellulose esters, cellulose amides, polyvinyl acetates, polyamides, gelatines, methylcelluloses, carboxymethylcelluloses and salts thereof, dextrins, ethylcelluloses, hydroxyethyl celluloses, hydroxypropyl methylcelluloses, maltodextrins, copolymers thereof, blends thereof, and combinations thereof.

10. The capsule of claim 1, wherein the water-soluble polymer comprises polyvinyl alcohol.

11. The capsule of claim 10, wherein the polyvinyl alcohol has a degree of hydrolysis in a range of about 75% to about 99%.

12. The capsule of claim 10, wherein the polyvinyl alcohol comprises a polyvinyl alcohol copolymer consisting essentially of vinyl alcohol monomeric repeat units and vinyl acetate monomeric repeat units.

13. The capsule of claim 10, wherein the polyvinyl alcohol comprises a polyvinyl alcohol copolymer comprising vinyl alcohol monomeric repeat units, vinyl acetate monomeric repeat units, and at least one other type of monomeric repeat units.

14. The capsule of claim 1, wherein the capsule shell as formed remains intact for at least about 8 minutes when submerged in water heated to a temperature of about 40° C., as measured by Bleach Compatibility Method A.

15. The capsule of claim 1, wherein the capsule shell as formed remains intact for at least about 12 minutes when submerged in water heated to a temperature of about 40° C., as measured by Bleach Compatibility Method A.

16. The capsule of claim 1, wherein the capsule shell as formed remains intact for at least about 15 minutes when submerged in water heated to a temperature of about 40° C., as measured by Bleach Compatibility Method B.

17. The capsule of claim 1, wherein the capsule leaves no visible residue on laundry when washed with laundry for 61 minutes in an unheated wash cycle at a temperature in a range of about 20° C. to about 25° C.

18. The capsule of claim 1, wherein the capsule leaves no visible residue on laundry when (i) washed with laundry for 61 minutes in an unheated wash cycle at a temperature in a range of about 20° C. to about 25° C. and then (ii) rinsed at a temperature in a range of about 20° C. to about 25° C. with laundry for 36 minutes.

19. The capsule of claim 1, wherein the water-sensitive composition is capable of generating oxygen gas when contacted with at least one of liquid water and water vapor.

20. The capsule of claim 1, wherein the water-sensitive composition generates gas when contacted with a controlled air environment at 80% relative humidity and 38° C.

21. The capsule of claim 1, wherein:

(i) the water-sensitive composition generates gas when contacted with a controlled air environment at 80% relative humidity and 38° C. for a test period of 4 weeks; and (ii) the capsule shell does not substantially deform during the test period.

22. The capsule of claim 1, wherein the water-sensitive composition is alkaline.

23. The capsule of claim 1, wherein the water-sensitive composition comprises an inorganic bleach selected from the group consisting of carbonate salts, borate salts, phosphate salts, sulfate salts, silicate salts, percarbonate salts, perborate salts, perphosphate salts, persulfate salts, persilicate salts, and combinations thereof.

24. The capsule of claim 23, wherein the inorganic bleach composition comprises sodium percarbonate and sodium carbonate.

25. The capsule of claim 1, wherein the water-sensitive composition further comprises at least one of a bleach activator and a bleach catalyst.

26. The capsule of claim 1, wherein the water-sensitive composition is in a powder form.

27. The capsule of claim 1, wherein the water-sensitive composition is uncoated.

28. A delayed release capsule for delivery of a water-sensitive composition, the capsule comprising:

(a) a water-soluble capsule shell comprising polyvinyl alcohol and defining an interior capsule volume, wherein:

(i) the capsule shell has a wall thickness in a range of about 500 μm to about 3000 μm, and (ii) the capsule shell comprises a pinhole sized and shaped (A) to permit gaseous fluid communication between the interior capsule volume and an environment external to the capsule shell, and (B) to limit liquid fluid communication between the interior capsule volume and the external environment, (iii) the capsule shell comprises two or more capsule shell elements mated together in a slidable engagement to collectively define the capsule shell and the interior capsule volume, (iv) each capsule shell element comprises polyvinyl alcohol, and (v) at least one capsule shell element comprises the pinhole; and (b) a water-sensitive composition contained in the interior capsule volume and in contact with the capsule shell wall, the water-sensitive composition (i) being capable of generating hydrogen peroxide gas when contacted with at least one of liquid water and water vapor and (ii) comprising an inorganic bleach selected from the group consisting of carbonate salts, borate salts, phosphate salts, sulfate salts, silicate salts, percarbonate salts, perborate salts, perphosphate salts, persulfate salts, persilicate salts, and combinations thereof.

29. The capsule of claim 28, wherein the capsule shell has a substantially uniform wall thickness in a range of about 250 μm 500 μm to about 1500 μm.

30. The capsule of claim 28, wherein the water-sensitive composition further comprises at least one of a bleach activator and a bleach catalyst.

31. An article comprising:

(a) a water-soluble pouch comprising a water-soluble film and defining (i) an interior pouch volume and (ii) a pinhole sized and shaped to permit fluid communication between the interior pouch volume and an environment external to the water-soluble pouch;

(b) a delayed release capsule contained in the interior pouch volume, the capsule comprising:

(i) a capsule shell comprising a water-soluble polymer and defining an interior capsule volume, wherein:

the capsule shell has a wall thickness in a range of about 100 μm to about 5000 μm, the capsule shell comprises a pinhole sized and shaped (A) to permit gaseous fluid communication between the interior capsule volume and an environment external to the capsule shell, and (B) to limit liquid fluid communication between the interior capsule volume and the external environment, the capsule shell comprises two or more capsule shell elements mated together in a slidable engagement to collectively define the capsule shell and the interior capsule volume, each capsule shell element comprises the water-soluble polymer, and at least one capsule shell element comprises the pinhole, and (ii) a water-sensitive composition contained in the interior capsule volume and in contact with the capsule shell wall, the water-sensitive composition being capable of generating gas when contacted with at least one of liquid water and water vapor;

wherein the capsule shell pinhole is in fluid communication with the water-soluble pouch pinhole; and (c) a laundry detergent composition contained in the interior pouch volume;

wherein:

(i) the interior pouch volume comprises at least (A) a first compartment and (B) a second compartment physically separated from the first compartment;

(ii) the first compartment defines the pouch pinhole and contains the capsule; and (iii) the second compartment contains the laundry detergent composition.

32. The article of claim 31, wherein the water-soluble film comprises a water-soluble polymer, which can be the same as or different from the water-soluble polymer of the capsule shell.

33. A method for washing laundry, the method comprising:

(a) forming an aqueous wash medium in a washing vessel, the aqueous wash medium comprising (i) water, (ii) laundry, (iii) a laundry detergent composition, and (iv) the capsule according to claim 1, wherein the water-sensitive composition comprises an inorganic bleach composition;

(b) washing the laundry in the aqueous wash medium, wherein the water-sensitive composition is not released from the capsule into the aqueous wash medium until a wash cycle delay time of at least about 10 minutes is reached.

34. The method of claim 33, wherein the capsule and the laundry detergent composition are added to the washing vessel in the form of an article comprising:

(a) a water-soluble pouch comprising a water-soluble film and defining (i) an interior pouch volume and (ii) a pinhole sized and shaped to permit fluid communication between the interior pouch volume and an environment external to the water-soluble pouch;

(b) the capsule contained in the interior pouch volume, wherein the capsule shell pinhole is in fluid communication with the water-soluble pouch pinhole; and (c) the laundry detergent composition contained in the interior pouch volume.

35. The method of claim 33, wherein the laundry upon completion of washing is free from visible residue resulting from dissolution of the capsule shell.

36. The method of claim 33, wherein the wash cycle delay time is at least about 15 minutes.

37. A method for delayed release of a water-sensitive composition into an aqueous liquid medium, the method comprising:

(a) providing the capsule according to claim 1, wherein the water-sensitive composition comprises a cleaning composition;

(b) adding the capsule to an aqueous liquid medium comprising water; and (c) dissolving the capsule shell to release the cleaning composition into the aqueous liquid medium, wherein the cleaning composition is not released from the capsule into the aqueous liquid medium until a selected delay time is reached after addition of the capsule to the aqueous liquid medium.

38. The method of claim 37, wherein the delay time is at least about 10 minutes.

39. The method of claim 37, wherein the delay time is at least about 15 minutes.

40. A delayed release capsule comprising:

(a) a capsule shell comprising a water-soluble polymer and defining an interior capsule volume, wherein:

(i) the capsule shell has a wall thickness in a range of about 500 μm to about 5000 μm, (ii) the capsule shell comprises a pinhole sized and shaped (A) to permit gaseous fluid communication between the interior capsule volume and an environment external to the capsule shell, and (B) to limit liquid fluid communication between the interior capsule volume and the external environment, (iii) the capsule shell has a substantially uniform wall thickness such that the capsule shell wall has a local thickness within about 50% of an average wall thickness across substantially the entire capsule shell, (iv) the capsule shell comprises two or more capsule shell elements mated together in a slidable engagement to collectively define the capsule shell and the interior capsule volume, (v) each capsule shell element comprises the water-soluble polymer, and (vi) at least one capsule shell element comprises the pinhole; and (b) a water-sensitive composition contained in the interior capsule volume and in contact with the capsule shell wall, the water-sensitive composition being capable of generating gas when contacted with at least one of liquid water and water vapor.

41. The capsule of claim 40, wherein the interior capsule volume is in a range of about 0.1 ml to about 100 ml.

42. The capsule of claim 40, wherein the wall thickness is in a range of about 500 μm to about 1500 μm.

43. The capsule of claim 40, wherein the pinhole has a diameter (D) in a range of about 10 μm to about 1500 μm.

44. The capsule of claim 40, wherein the pinhole has length (L) and a diameter (D) with a corresponding L/D ratio in a range of about 0.01 to about 100.

45. The capsule of claim 1, wherein the wall thickness is in a range of about 500 μm to about 2500 μm.

46. The capsule of claim 1, wherein the wall thickness is in a range of about 750 μm to about 2500 μm.

47. The capsule of claim 1, wherein the pinhole has length (L) and a diameter (D) with a corresponding L/D ratio in a range of about 0.2 to about 100.

48. The capsule of claim 1, wherein the pinhole has length (L) and a diameter (D) with a corresponding L/D ratio in a range of about 0.5 to about 100.

* * * * *